US007449122B2

(12) United States Patent
Corbin et al.

(10) Patent No.: US 7,449,122 B2
(45) Date of Patent: Nov. 11, 2008

(54) MICRO-FABRICATED ELECTROKINETIC PUMP

(75) Inventors: David Corbin, Los Altos, CA (US); Kenneth Goodson, Belmont, CA (US); Thomas Kenny, San Carlos, CA (US); Juan Santiago, Fremont, CA (US); Shulin Zeng, Sunnyvale, CA (US)

(73) Assignee: Cooligy Inc., Mountain View, CA (US)

( * ) Notice: Subject to any disclaimer, the term of this patent is extended or adjusted under 35 U.S.C. 154(b) by 520 days.

(21) Appl. No.: 10/968,376

(22) Filed: Oct. 18, 2004

(65) Prior Publication Data

US 2005/0084385 A1 Apr. 21, 2005

Related U.S. Application Data

(62) Division of application No. 10/366,121, filed on Feb. 12, 2003, now Pat. No. 6,881,039.

(60) Provisional application No. 60/413,194, filed on Sep. 23, 2002.

(51) Int. Cl.
*F04B 1/00* (2006.01)

(52) U.S. Cl. ..... 216/2; 216/56

(58) Field of Classification Search ..... None
See application file for complete search history.

(56) References Cited

U.S. PATENT DOCUMENTS

| | | | | |
|---|---|---|---|---|
| 0,596,062 | A | 12/1897 | Firey | |
| 2,273,505 | A | 2/1942 | Florian | |
| 3,267,859 | A | 8/1966 | Jutila | |
| 3,524,497 | A | 8/1970 | Chu et al. | 165/80 |
| 3,554,669 | A | 1/1971 | Reader | |
| 3,654,988 | A | 4/1972 | Clayton, III | |

(Continued)

FOREIGN PATENT DOCUMENTS

| | | |
|---|---|---|
| CN | 97212126.9 | 3/1997 |

(Continued)

OTHER PUBLICATIONS

"*Closed Loop Electroosmotic Microchannel Cooling System for VLSI Circuits*", Linan Jang et al., Department of Mechanical Engineering, Stanford University, pp. 1-27.

(Continued)

*Primary Examiner*—Allan Olsen
(74) *Attorney, Agent, or Firm*—Haverstock & Owens LLP

(57) ABSTRACT

An electrokinetic pump for pumping a liquid includes a pumping body having a plurality of narrow, short and straight pore apertures for channeling the liquid through the body. A pair of electrodes for applying a voltage differential are formed on opposing surfaces of the pumping body at opposite ends of the pore apertures. The pumping body is formed on a support structure to maintain a mechanical integrity of the pumping body. The pump can be fabricated using conventional semiconductor processing steps. The pores are preferably formed using plasma etching. The structure is oxidized to insulate the structure and also narrow the pores. A support structure is formed by etching a substrate and removing an interface oxide layer. Electrodes are formed to apply a voltage potential across the pumping body. Another method of fabricating an electrokinetic pump includes providing etch stop alignment marks so that the etch step self-terminates.

19 Claims, 6 Drawing Sheets

U.S. PATENT DOCUMENTS

| | | | | |
|---|---|---|---|---|
| 3,817,321 | A | 6/1974 | Von Cube et al. | |
| 3,823,572 | A | 7/1974 | Cochran, Jr. | |
| 3,923,426 | A | 12/1975 | Theeuwes | 417/48 |
| 3,993,123 | A | 11/1976 | Chu et al. | 165/80 |
| 4,138,996 | A | 2/1979 | Cartland | |
| 4,211,208 | A | 7/1980 | Lindner | |
| 4,296,455 | A | 10/1981 | Leaycraft et al. | 361/383 |
| 4,485,429 | A | 11/1984 | Mittal | |
| 4,568,431 | A | 2/1986 | Polan et al. | 204/13 |
| 4,726,495 | A | 2/1988 | Bavaveas | 257/722 |
| 4,884,331 | A | 12/1989 | Hinshaw | 29/558 |
| 4,978,638 | A | 12/1990 | Buller et al. | 437/209 |
| 5,016,090 | A | 5/1991 | Galyon et al. | 357/82 |
| 5,088,005 | A | 2/1992 | Ciaccio | 361/385 |
| 5,096,388 | A | 3/1992 | Weinberg | |
| 5,131,233 | A | 7/1992 | Cray et al. | |
| 5,219,278 | A | 6/1993 | Van Lintel | |
| 5,239,200 | A | 8/1993 | Messina et al. | 257/714 |
| 5,247,800 | A | 9/1993 | Mruzek et al. | 62/51.1 |
| 5,269,372 | A | 12/1993 | Chu et al. | 165/80.4 |
| 5,308,429 | A | 5/1994 | Bradley | 156/306.6 |
| 5,309,319 | A | 5/1994 | Messina | 361/699 |
| 5,316,077 | A | 5/1994 | Reichard | 165/104.28 |
| 5,336,062 | A | 8/1994 | Richter | |
| 5,371,529 | A | 12/1994 | Eguchi | |
| 5,380,956 | A | 1/1995 | Loo et al. | |
| 5,441,613 | A | 8/1995 | McCormick et al. | |
| 5,459,099 | A | 10/1995 | Hsu | |
| 5,534,471 | A | 7/1996 | Carolan et al. | |
| 5,590,242 | A | 12/1996 | Juang et al. | 395/2.54 |
| 5,632,876 | A | 5/1997 | Zanzucchi et al. | |
| 5,641,400 | A | 6/1997 | Kaltenbach et al. | |
| 5,685,966 | A | 11/1997 | Aaron et al. | 204/600 |
| 5,703,536 | A | 12/1997 | Davis et al. | |
| 5,704,416 | A | 1/1998 | Larson et al. | |
| 5,759,014 | A | 6/1998 | Van Lintel | |
| 5,761,037 | A | 6/1998 | Anderson et al. | 361/700 |
| 5,763,951 | A | 6/1998 | Hamilton et al. | |
| 5,800,690 | A | 9/1998 | Chow et al. | |
| 5,829,514 | A | 11/1998 | Smith et al. | 165/78 |
| 5,835,345 | A | 11/1998 | Staskus et al. | |
| 5,836,750 | A | 11/1998 | Cabuz | |
| 5,839,290 | A | 11/1998 | Nazeri | |
| 5,858,188 | A | 1/1999 | Soane et al. | |
| 5,863,708 | A | 1/1999 | Zanzucchi et al. | |
| 5,870,823 | A | 2/1999 | Bezama et al. | |
| 5,876,655 | A | 3/1999 | Fisher | |
| 5,880,524 | A | 3/1999 | Xie | |
| 5,901,037 | A | 5/1999 | Hamilton et al. | 361/699 |
| 5,937,557 | A | 8/1999 | Bowker et al. | 42/70.1 |
| 5,940,270 | A | 8/1999 | Puckett | |
| 5,942,093 | A | 8/1999 | Rakestraw et al. | |
| 5,953,701 | A | 9/1999 | Neti et al. | 704/254 |
| 5,960,384 | A | 9/1999 | Brash | 704/9 |
| 5,964,092 | A | 10/1999 | Tozuka et al. | |
| 5,965,001 | A | 10/1999 | Chow et al. | |
| 5,965,813 | A | 10/1999 | Wan et al. | |
| 5,978,220 | A | 11/1999 | Frey et al. | |
| 5,983,997 | A | 11/1999 | Hou | 165/144 |
| 5,989,402 | A | 11/1999 | Chow et al. | |
| 5,997,713 | A | 12/1999 | Beetz, Jr. et al. | |
| 5,998,240 | A | 12/1999 | Hamilton et al. | |
| 6,007,309 | A | 12/1999 | Hartley | |
| 6,010,316 | A | 1/2000 | Haller et al. | |
| 6,012,902 | A | 1/2000 | Parce | |
| 6,013,164 | A | 1/2000 | Paul et al. | |
| 6,019,165 | A | 2/2000 | Batchelder | 165/80.3 |
| 6,019,882 | A | 2/2000 | Paul et al. | |
| 6,023,934 | A | 2/2000 | Gold | 62/51.1 |
| 6,054,034 | A | 4/2000 | Soane et al. | |
| 6,068,752 | A | 5/2000 | Dubrow et al. | |
| 6,084,178 | A | 7/2000 | Cromwell | 174/35 |
| 6,090,251 | A | 7/2000 | Sundberg et al. | |
| 6,096,656 | A | 8/2000 | Matzke et al. | |
| 6,100,541 | A | 8/2000 | Nagle et al. | |
| 6,101,715 | A | 8/2000 | Fuesser et al. | |
| 6,103,199 | A | 8/2000 | Bjornson et al. | 422/100 |
| 6,106,685 | A | 8/2000 | McBride et al. | 204/600 |
| 6,119,729 | A | 9/2000 | Oberholzer et al. | |
| 6,129,145 | A | 10/2000 | Yamamoto et al. | |
| 6,146,103 | A | 11/2000 | Lee et al. | |
| 6,154,226 | A | 11/2000 | York et al. | 346/140.1 |
| 6,154,363 | A | 11/2000 | Chang | |
| 6,171,067 | B1 | 1/2001 | Parce | |
| 6,174,675 | B1 | 1/2001 | Chow et al. | |
| 6,176,962 | B1 | 1/2001 | Soane et al. | |
| 6,182,742 | B1 | 2/2001 | Takahashi et al. | 165/104.33 |
| 6,186,660 | B1 | 2/2001 | Kopf-Sill et al. | |
| 6,210,986 | B1 | 4/2001 | Arnold et al. | |
| 6,216,343 | B1 | 4/2001 | Leland et al. | |
| 6,221,226 | B1 | 4/2001 | Kopf-Sill | |
| 6,227,809 | B1 | 5/2001 | Forster et al. | |
| 6,234,240 | B1 | 5/2001 | Cheon | |
| 6,238,538 | B1 | 5/2001 | Parce et al. | |
| 6,251,254 | B1 | 6/2001 | Katoh et al. | 205/287 |
| 6,260,579 | B1 | 7/2001 | Yokota et al. | 137/807 |
| 6,272,012 | B1 | 8/2001 | Medin et al. | 361/690 |
| 6,277,257 | B1 | 8/2001 | Paul et al. | |
| 6,287,440 | B1 | 9/2001 | Arnold et al. | |
| 6,301,109 | B1 | 10/2001 | Chu et al. | |
| 6,313,992 | B1 | 11/2001 | Hildebrandt | |
| 6,321,791 | B1 | 11/2001 | Chow | |
| 6,322,753 | B1 | 11/2001 | Lindberg et al. | |
| 6,324,058 | B1 | 11/2001 | Hsiao | |
| 6,337,794 | B1 | 1/2002 | Agonafer et al. | |
| 6,351,384 | B1 | 2/2002 | Daikoku et al. | |
| 6,381,846 | B2 | 5/2002 | Insley et al. | 29/890.039 |
| 6,385,044 | B1 | 5/2002 | Colbert et al. | 361/700 |
| 6,388,317 | B1 | 5/2002 | Reyzin | |
| 6,388,385 | B1 | 5/2002 | McGinn et al. | 315/111.91 |
| 6,396,706 | B1 | 5/2002 | Wohlfarth | 361/760 |
| 6,397,932 | B1 | 6/2002 | Calaman et al. | |
| 6,416,642 | B1 | 7/2002 | Alajoki et al. | |
| 6,417,060 | B2 | 7/2002 | Tavkhelidze et al. | |
| 6,443,704 | B1 | 9/2002 | Darabi et al. | 417/50 |
| 6,457,515 | B1 | 10/2002 | Vafai et al. | |
| 6,478,258 | B1 | 11/2002 | Yee | 244/163 |
| 6,495,015 | B1 | 12/2002 | Schoeniger et al. | |
| 6,527,835 | B1 | 3/2003 | Manginell et al. | 96/102 |
| 6,572,749 | B1 | 6/2003 | Paul et al. | |
| 6,574,597 | B1 | 6/2003 | Mohri et al. | 704/251 |
| 6,578,626 | B1 | 6/2003 | Calaman et al. | 165/80.4 |
| 6,588,498 | B1 | 7/2003 | Reyzin et al. | |
| 6,632,655 | B1 | 10/2003 | Mehta et al. | |
| 6,675,875 | B1 | 1/2004 | Vafai et al. | 165/80.4 |
| 6,719,535 | B2 | 4/2004 | Rakestraw et al. | 417/50 |
| 6,729,383 | B1 | 5/2004 | Cannell et al. | 165/80.3 |
| 6,770,183 | B1 | 8/2004 | Hencken et al. | |
| 6,775,996 | B2 | 8/2004 | Cowans | 62/160 |
| 6,865,081 | B2 | 3/2005 | Meyer et al. | 361/699 |
| 6,903,929 | B2 | 6/2005 | Prasher et al. | 361/699 |
| 6,934,154 | B2 | 8/2005 | Prasher et al. | 361/699 |
| 6,986,382 | B2 | 1/2006 | Upadhya et al. | 165/80.4 |
| 6,992,891 | B2 | 1/2006 | Mallik et al. | 361/704 |
| 2001/0016985 | A1 | 8/2001 | Insley et al. | |
| 2001/0024820 | A1 | 9/2001 | Mastromatteo et al. | |
| 2001/0044155 | A1 | 11/2001 | Paul et al. | |
| 2001/0046703 | A1 | 11/2001 | Burns et al. | |
| 2001/0055714 | A1 | 12/2001 | Cettour-Rose et al. | |
| 2002/0011330 | A1 | 1/2002 | Insley et al. | |
| 2002/0031948 | A1 | 3/2002 | Yasufuku et al. | 439/625 |
| 2002/0075645 | A1 | 6/2002 | Kitano et al. | |
| 2002/0096312 | A1 | 7/2002 | Korin | |
| 2002/0121105 | A1 | 9/2002 | McCarthy, Jr. et al. | |

| | | | | |
|---|---|---|---|---|
| 2002/0134543 | A1 | 9/2002 | Estes et al. | 165/277 |
| 2002/0152761 | A1 | 10/2002 | Patel et al. | 62/259.2 |
| 2003/0022505 | A1 | 1/2003 | Quellet et al. | |
| 2003/0062149 | A1 | 4/2003 | Goodson et al. | 165/104.11 |
| 2003/0097846 | A1 | 5/2003 | Novotny et al. | 62/3.7 |
| 2003/0121274 | A1 | 7/2003 | Wightman | |
| 2004/0040695 | A1 | 3/2004 | Chesser et al. | |
| 2004/0050231 | A1 | 3/2004 | Chu et al. | 83/574 |
| 2004/0052049 | A1 | 3/2004 | Wu et al. | 361/699 |
| 2004/0052711 | A1 | 3/2004 | Kondo et al. | 361/696 |
| 2004/0089008 | A1 | 5/2004 | Tilton et al. | |
| 2004/0099410 | A1 | 5/2004 | Ghosh | 165/185 |
| 2004/0112585 | A1 | 6/2004 | Goodson et al. | 165/299 |
| 2004/0120827 | A1 | 6/2004 | Kim et al. | |
| 2004/0206477 | A1 | 10/2004 | Kenny et al. | 165/80.4 |
| 2005/0082666 | A1 | 4/2005 | Lee et al. | 257/728 |
| 2005/0083657 | A1 | 4/2005 | Hamman | 361/699 |
| 2005/0084385 | A1 | 4/2005 | Corbin et al. | 417/53 |
| 2005/0117298 | A1 | 6/2005 | Koga et al. | 361/699 |
| 2005/0257532 | A1 | 11/2005 | Ikeda et al. | 62/3.7 |
| 2006/0133039 | A1 | 6/2006 | Belady | 361/699 |
| 2007/0115634 | A1 | 5/2007 | Laing | 361/699 |

FOREIGN PATENT DOCUMENTS

| | | | |
|---|---|---|---|
| DE | 42 42 841 | A1 | 11/1997 |
| EP | 1 154 476 | A1 | 11/2001 |
| JP | 10-99592 | | 4/1998 |
| JP | 2000-277540 | | 10/2000 |
| JP | 2001-326311 | | 11/2001 |
| TW | 495062 | | 7/2002 |
| TW | 510490 | | 11/2002 |
| WO | WO 2004/036040 | A1 | 4/2004 |
| WO | WO 2004/076857 | A3 | 9/2004 |

OTHER PUBLICATIONS

"*Modeling of Two-Phase Microchannel Heat Sinks for VSLI Chips*", Jae-Mo Koo et al., Mechanical Engineering Department, Stanford University, Stanford CA. 94305-3030, pp. 422-426.

Stephen C. Jacobson et al., "Fused Quartz Substrates for Microchip Electrophoresis", Analytical Chemistry, vol. 67, No. 13, Jul. 1, 1995, pp. 2059-2063.

Kendra V. Sharp et al., "Liquid Flows in Microchannels", 2002, vol. 6, pp. 6-1 to 6-38.

Shuchi Shoji et al., "Microflow devices and systems", J. Microcech. Microeng. 4 (1994), pp. 157-171, printed in the U.K.

Angela Rasmussen et al., "Fabrication Techniques to Realize CMOS-Compatible Microfluidic Microchannels", Journal of Microelectromechanical, Vo. 10, No. 2, Jun. 2001, pp. 286-297.

J. H. Wang et al., "Thermal-Hydraulic Characteristic of Micro Heat Exchangers", 1991, DSC-vol. 32, Micromechanical Sensors, Actuators, and Systems, pp. 331-339.

Gad Hetsroni et al., "Nonuniform Temperature Distribution in Electronic Devices Cooled by Flow in Parallel Microchannels", IEEE Transactions on Components and Packaging Technologies, Mar. 2001, vol. 24, No. 1, pp. 16-23.

X. F. Peng et al., "Heat Transfer Characteristics of Water Flowing through Microchannels", Experimental Heat Transfer An International Journal, vol. 7, No. 4, Oct.-Dec. 1994, pp. 265-283.

Linan Jiang et al., "Forced Convection Boiling in a Microchannel Heat Sink", Journal of Microelectromechanical Systems, vol. 10, No. 1, Mar. 2001, pp. 80-87.

Muhammad M. Rahman et al., "Experimental Measurements of Fluid Flow and Heat Transfer in Microchannel Cooling Passages in a Chip Substrate", 1993, EEP-vol. 4-2, Advances in Electronic Packages, pp. 685-692.

X. F. Peng et al., "Forced convection and flow boiling heat transfer for liquid flowing through Microchannels", 1993, Int. J. Heat Mass Transfer, vol. 36, No. 14, pp. 3421-3427.

Lung-Jieh Yang et al., "A Micro Fluidic System of Micro Channels with On-Site Sensors by Silicon Bulk Micromaching", Sep. 1999, Microfluidic Devices and Systems II, vol. 3877, pp. 267-272.

G. Mohiuddin Mala et al., "Heat transfer and fluid flow in microchannels", 1997, Int. J. Mass transfer, vol. 40, No. 13, pp. 3079-3088, printed in Great Britain.

J. M. Cuta et al., "Fabrication and Testing of Micro-Channel Heat Exchangers", SPIE Microlithography and Metrology in Micromaching, vol. 2640, 1995, pp. 152-160.

Linan Jiang et al., "A Micro-Channel Heat Sink with Integrated Temperature Sensors for Phase Transition Study", 1999, 12th IEEE International Conference on Micro Electro Mechanical Systems, pp. 159-164.

Linan Jiang et al., "Fabrication and characterization of a microsystem for a micro-scale heat transfer study", J. Micromech. Microeng. 9 (1999) pp. 422-428, printed in the U.K.

M. B. Bowers et al., "High flux boiling in low flow rate, low pressure drop mini-channel and micro-channel heat sinks", 1994, Int. J. Heat Mass Transfer, vol. 37, No. 2, pp. 321-332.

Yongendra Joshi, "Heat out of small packages", Dec. 2001, Mechanical Engineering, pp. 56-58.

A. Rostami et al., "Liquid Flow and Heat Transfer in Microchannels: A Review", 2000, Heat and Technology, vol. 18, No. 2, pp. 59-68.

Lian Zhang et al., "Measurements and Modeling of Two-Phase Flow in Microchannels with Nearly Constant Heat Flux Boundary Conditions", Journal of Microelectromechanical Systems, vol. 11, No. 1, Feb. 2002, pp. 12-19.

Muhammad Mustafizur Rahman, "Measurements of Heat Transfer in Microchannel Heat Sinks", Int. Comm. Heat Mass Transfer, vol. 27, No. 4, May 2000, pp. 495-506.

Issam Mudawar et al., "Enhancement of Critical Heat Flux from High Power Microelectronic Heat Sources in a Flow Channel",Journal of Electronic Packaging, Sep. 1990, vol. 112, pp. 241-248.

Nelson Kuan, "Experimental Evaluation of Micro Heat Exchangers Fabricated in Silicon", 1996, HTD-vol. 331, National Heat Transfer Conference, vol. 9, pp. 131-136.

E. W. Kreutz et al., "Simulation of micro-channel heat sinks for optoelectronic microsystems", Microelectronics Journal 31(2000), pp. 787-790.

J. C. Y. Koh et al., "Heat Transfer of Microstructures for Integrated Circuits", 1986, Int. Comm. Heat Mass Transfer, vol. 13, pp. 89-98.

Snezana Konecni et al., "Convection Cooling of Microelectronic Chips", 1992, Inter Society Conference on Thermal Phenomena, pp. 138-144.

Michael B. Kleiner et al., "High Performance Forced Air Cooling Scheme Employing Microchannel Heat Exchangers", Dec. 1995, IEEE Transactions on Components, Packaging, and Manufacturing Technology-Part A, vol. 18, No. 4, pp. 795-804.

Jerry K. Keska Ph. D. et al., "An Experimental Study on an Enhanced Microchannel Heat Sink for Microelectronics Applications", EEP-vol. 26-2, Advances in Electronic Packaging, 1999, vol. 2, pp. 1235-1259.

Shung-Wen Kang et al., "The Performance Test and Analysis of Silicon-Based Microchannel Heat Sink", Jul. 1999, Terahertz and Gigahertz Photonics, vol. 3795, pp. 259-270.

Joseph C. Tramontana, "Semiconductor Laser Body Heat Sink", Xerox Disclosure Journal, vol. 10, No. 6, Nov./Dec. 1985, pp. 379-381.

Sarah Arulanandam et al., "Liquid transport in rectangular microchannels by electroosmotic pumping", Colloids and Surfaces A: Physicochemical and Engineering Aspects 161 (2000), pp. 89-102.

Jeffery D. Barner et al., "Thermal Ink Jet Print Head Carriage with Integral Liquid Cooling Capabilities", Xerox Disclosure Journal-vol. 21, No. 1, Jan./Feb. 1996, pp. 33-34.

"Autonomous displacement of a solution in a microchannel by another solution", Research Disclosure, Jun. 2001, pp. 1046-1047.

John M. Waldvogel, "Aluminum Silicon Carbide Phase Change Heat Spreader", Motorola, Jun. 1999, Technical Developments, pp. 226-230.

James P. Slupe et al., "An idea for maintaining a stable thermal environment for electronic devices", Research Disclosure, Aug. 2001, p. 1312.

John M. Waldvogel, "A Heat Transfer Enhancement Method for Forced Convection Bonded-Fin Heatsinks", Motorola, Dec. 1997, Technical Developments, pp. 158-159.

"Thin Heat Pipe for Cooling Components on Printed Circuit Boards", IBM Technical Disclosure Bulletin, vol. 34, No. 7B, Dec. 1991, pp. 321-322.
R. C. Chu et al., "Process for Nucleate Boiling Enhancement", IBM Technical Disclosure Bulletin, vol. 18, No. 7, Dec. 1975, p. 2227.
J. Riseman, "Structure for Cooling by Nucleate Boiling", IBM Technical Disclosure Bulletin, vol. 18, No. 11, Apr. 1976, p. 3700.
"Integrally Grooved Semiconductor Chip and Heat Sink", Oct. 1971, IBM Technical Disclosure Bulletin, vol. 14, No. 5, p. 1425.
"Enhanced Cooling of Thermal Conduction Module", IBM Technical Disclosure Bulletin, vol. 30, No. 5, Oct. 1987, p. 426.
"Heat Exchanger Modules for Data Processor with Valves Operated by Pressure from Cooling Water Pump", IBM Technical Disclosure Bulletin, vol. 30, No. 5, Oct. 1987, p. 419.
"Cold Plate for Thermal Conduction Module with Inlet for Cooling Water Near Highest Power Chips", IBM Technical Disclosure Bulletin, vol. 30, No. 5, Oct. 1987, p. 413.
"Circuit Module Cooling with Coaxial Bellows Providing Inlet, Outlet and Redundant Connections to Water-Cooled Element", IBM Technical Bulletin, vol. 30, No. 5, Oct. 1987, pp. 345-347.
"Piping System with Valves Controlled by Processor for Heating Circuit Modules in a Selected Temperature Profile for Sealing Integrity Test Under Temperature Stress", IBM Technical Disclosure Bulletin, vol. 30, No. 5, Oct. 1987, p. 336.
"Cooling System for Chip Carrier on Card", IBM Technical Disclosure Bulletin, vol. 31, No. 4, Sep. 1988, pp. 39-40.
"Chip Cooling Device", IBM Technical Disclosure Bulletin, vol. 30, No. 9, Feb. 1988, pp. 435-436.
W. E. Ahearn et al., "Silicon Heat Sink Method to Control Integrated Circuit Chip Operating Temperatures", IBM Technical Disclosure Bulletin, vol. 21, No. 8, Jan. 1979, pp. 3378-3380.
N. P. Bailey et al., "Cooling Device for Controlled Rectifier", IBM Technical Disclosure Bulletin, vol. 21, No. 11, Apr. 1979, pp. 4609-4610.
W. J. Kleinfelder et al., "Liquid-Filled Bellows", IBM Technical Disclosure Bulletin, vol. 21, No. 10, Mar. 1979, pp. 4125-4126.
R. P. Chrisfield et al., "Distributed Power/Thermal Control", IBM Technical Disclosure Bulletin, vol. 22, No. 3, Aug. 1979, pp. 1131-1132.
A. J. Arnold et al., "Heat Sink Design for Cooling Modules in a Forced Air Environment", IBM Technical Disclosure Bulletin, vol. 22, No. 6, Nov. 1979, pp. 2297-2298.
A. J. Arnold, "Structure for the Removal of Heat from an Integrated Circuit Module", IBM Technical Disclosure Bulletin, vol. 22, No. 6, Nov. 1979, pp. 2294-2296.
U. P. Hwang et al., "Cold Plate for Thermal Conduction Module with Improved Flow Pattern and Flexible Base", IBM Technical Disclosure Bulletin, vol. 25, No. 9, Feb. 1983, p. 4517.
K. C. Gallagher et al., "Cooling System for Data Processor with Flow Restricter in Secondary Loop to Limit Bypass-Cooling Water Flow", IBM Technical Disclosure Bulletin, vol. 26, No. 5, Oct. 1983, p. 2658.
R. C. Chu et al., "Silicon Heat Sink for Semiconductor Chip", IBM Technical Disclosure Bulletin, vol. 24, No. 11A, Apr. 1982, p. 5743.
J. M. Eldridge et al., "Heat-Pipe Vapor Cooling Etched Silicon Structure", IBM Technical Disclosure Bulletin, vol. 25, No. 8, Jan. 1983, pp. 4118-4119.
J. R. Skobern, "Thermoelectrically Cooled Module", IBM Technical Disclose Bulletin, vol. 27, No. 1A, Jun. 1984, p. 30.
M. J. Brady et al., "Etched Silicon Integrated Circuit Heat Sink", IBM Technical Disclosure Bulletin, vol. 27, No. 1B, Jun. 1984, p. 627.
H. D. Edmonds et al., "Heat Exchange Element for Semiconductor Device Cooling", IBM Technical Disclosure Bulletin, vol. 23, No. 3, Aug. 1980, p. 1057.
R. W. Noth, "Heat Transfer from Silicon Chips and Wafers", IBM Technical Disclosure Bulletin, vol. 17, No. 12, May 1975, p. 3544.
"Forced Boiling Cooling System with Jet Enhancement for Critical Heat Flux Extension", IBM Technical Disclosure Bulletin, vol. 39, No. 10, Oct. 1996, p. 143.
"Miniature Heat Exchanger for Corrosive Media", IBM Technical Disclosure Bulletin, vol. 38, No. 01, Jan. 1995, pp. 55-56.
"Self-Contained Active Heat Dissipation Device", IBM Technical Disclosure Bulletin, vol. 39, No. 04, Apr. 1996, pp. 115-116.
C. J. Keller et al., "Jet Cooling Cup for Cooling Semiconductor Devices", IBM Technical Disclosure Bulletin, vol. 20, No. 9, Feb. 1978, pp. 3575-3576.
B. J. Ronkese, "Centerless Ceramic Package with Directly Connected Heat Sink", IBM Technical Disclosure Bulletin, vol. 20, No. 9, Feb. 1978, p. 3577-3578.
K. S. Sachar, "Liquid Jet Cooling of Integrated Circuit Chips", vol. 20, No. 9, Feb. 1978, pp. 3727-3728.
A. H. Johnson, "Device Cooling", IBM Technical Disclosure Bulletin, vol. 20, No. 10, Mar. 1978, pp. 3919-3920.
R. D. Durand et al., "Flexible Thermal Conductor for Electronic Module", IBM Technical Disclosure Bulletin, vol. 20, No. 11A, Apr. 1978, p. 4343.
D. Balderes et al., "Liquid Cooling of a Multichip Module Package", IBM Technical Disclosure Bulletin, vol. 20, No. 11A, Apr. 1978, pp. 4336-4337.
J. A. Dorler et al., "Temperature Triggerable Fluid Coupling System for cooling Semiconductor Dies", IBM Technical Disclosure Bulletin, vol. 20, No. 11A, Apr. 1978, pp. 4386-4388.
V. W. Antonetti et al., "Integrated Module Heat Exchanger", IBM Technical Disclosure Bulletin, vol. 20, No. 11A, Apr. 1978, p. 4498.
P. Hwang et al., "Conduction Cooling Module", IBM Technical Disclosure Bulletin, vol. 20, No. 11A, Apr. 1978, pp. 4334-4335.
A. J. Arnold et al., "Electronic Packaging Structure", IBM Technical Disclosure Bulletin, vol. 20, No. 11B, Apr. 1978, pp. 4820-4822.
V. Y. Doo et al., "High Performance Package for Memory", IBM Technical Disclosure Bulletin, vol. 21, No. 2, Jul. 1978, pp. 585-586.
"Multi-Chip Package with Cooling by a Spreader Plate in Contact with a Chip having Cylindrical Holes Mating with an Inverse Frame Providing Water Flow Within its Pins", IBM Technical Disclosure Bulletin, vol. 31, No. 5, Oct. 1988, pp. 141-142.
J. Landrock et al., "Cooling System for Semiconductor Chips", IBM Technical Disclosure Bulletin, vol. 23, No. 4, Sep. 1980, p. 1483.
E. P. Damm, Jr., "Convection Cooling Apparatus", IBM Technical Disclosure Bulletin, vol. 20, No. 7, Dec. 1977, pp. 2755-2756.
"Circuit Package with Circulating Boiling Liquid and Local Heat Exchanger to Limit Vapor in Coolant Outlet", IBM Technical Disclosure Bulletin, vol. 31, No. 12, May 1989, p. 34.
"Circuit Module Cooling with Multiple Pistons Contacting a Heat Spreader/Electrical Buffer Plate in Contact with Chip", IBM Technical Disclosure Bulletin, vol. 31, No. 12, May 1989, p. 5-7.
"TCM-Like Circuit Module with Local Heat Sink Resting on Chip and Chip Separated From Coolant by Bellows with Pins and Deflector Plate Attached to Local Heat Sink and Extending Above Bellows into Region of Coolant Flow", IBM Technical Disclosure Bulletin, vol. 31, No. 11, pp. 305-306.
"Water-Cooled Circuit Module with Grooves Forming Water Passages Near Heat-Producing Devices", IBM Technical Disclosure Bulletin, vol. 31, No. 12, May 1989, pp. 49-50.
"Cold Plate for Thermal Conduction Module with Only Peripheral Mounting Bolts, Large Surface Area Fin Inserts and Reduced Water Flow and Thermal Resistances", IBM Technical Disclosure Bulletin, vol. 31, No. 12, May 1989, p. 59.
"Thermal Control Hardware for Accelerated Run-In Testing of Multi-Chip Modules", IBM Technical Disclosure Bulletin, vol. 32, No. 5A, Oct. 1989, p. 129-130.
"Means of Removing More Heat From a TCM (Or Other Liquid-Cooled Logic Package) By Reducing the Coolant Temperature", IBM Technical Disclosure Bulletin, vol. 32, No. 5A, Oct. 1989, pp. 153-154.
E. G. Loeffel et al., "Liquid Cooled Module with Compliant Membrane", IBM Technical Disclosure Bulletin, vol. 20, No. 2, Jul. 1977, pp. 673-674.
V. Y. Doo et al., "Method of Effective Cooling of a High Power Silicon Chip", IBM Technical Disclosure Bulletin, vol. 20, No. 4, Sep. 1977, p. 1436-1437.
V. Y. Doo et al., Semiconductor Chip Cooling Package, IBM Technical Disclosure Bulletin, vol. 20, No. 4, Sep. 1977, pp. 1440-1441.
"Heat Sink Fabrication Method", IBM Technical Disclosure Bulletin, vol. 27, No. 10A, Mar. 1985, p. 5656-5657.
"Thermal Conduction Module with Liquid Dielectric and Pistons with Surface Treatment for Enhanced Nucleate Boiling", IBM Technical Disclosure Bulletin, vol. 27, No. 12, May 1985, p. 6904.

"Pin Fin Array Heat Pipe Apparatus", IBM Technical Disclosure Bulletin, vol. 37, No. 09, Sep. 1994, p. 171.
Youngcheol Joo et al., "Fabrication of Monolithic Microchannels for IC Chip Cooling", 1995, IEEE Micro Electro Mechanical Systems, pp. 362-367.
Jaisree Moorthy et al., "Active control of electroosmotic flow in microchannels using light", Jan. 26, 2001, Sensors and Actuators B 75, pp. 223-229.
Andreas Manz et al., "Electroosmotic pumping and electrophoretic separations for miniaturized chemical analysis systems", Sep. 16, 1994, J.Micromech. Microeng. 4 (1994), pp. 257-265, printed in the U.K.
E. B. Cummings et al., "Irrotationality of uniform electroosmosis", Sep. 1999, Part of the SPIE Conference on Microfluidic Devices and Systems II, SPIE vol. 3877, pp. 180-189.
Haim H. Bau, "Optimization of conduits' shape in micro heat exchangers", Dec. 10, 1997, International Journal of Heat and Mass Transfer 41 (1998), pp. 2717-2723.
V. K. Dwivedi et al., "Fabrication of very smooth walls and bottoms of silicon microchannels for heat dissipation of semiconductor devices", Jan. 25, 2000, Microelectronics Journal 31 (2000), pp. 405-410.
M. B. Bowers et al.,, "Two-Phase Electronic Cooling Using Mini-Channel Heat Sinks: Part 2-Flow Rate and Pressure Drop Constraints", Dec. 1994, Journal of Electronic Packaging, vol. 116, pp. 298-305.
Meint J. de Boer et al., "Micromachining of Buried Micro Channels in Silicon", Mar. 2000, Journal of Microelectromechanical systems, vol. 9, No. 1, pp. 94-103.
S.B. Choi et al., "Fluid Flow and Heat Transfer in Microtubes", 1991, DSC-vol. 32, Micromechanical sensors, Actuators, and Systems, ASME 1991, pp. 123-134.
S. F. Choquette, M. Faghri et al., "Optimum Design of Microchannel Heat Sinks", 1996, DSC-vol. 59, Microelectromechanical Systems (MEMS), ASME 1996, pp. 115-126.
David Copeland et al., "Manifold Microchannel Heat Sinks: Theory and Experiment", 1995, EEP-vol. 10-2, Advances in Electronic Packaging ASME, 1995, pp. 829-835.
J. M. Cuta et al., "Forced Convection Heat Transfer in Parallel Channel Array Microchannel Heat Exchanger", 1996, PID-vol. 2 / HTD-vol. 338, Advances in Energy efficiency, Heat/Mass Transfer Enhancement, ASME 1996, pp. 17-23.
K. Fushinobu et al., "Heat Generation and Transport in Sub-Micron Semiconductor Devices", HTD-vol. 253, Heat Transfer on the Microscale, ASME 1993, pp. 21-28.
Charlotte Gillot et al., "Integrated Micro Heat Sink for Power Multichip Module", IEEE Transactions on Industry Applications, vol. 36, No. 1, Jan./Feb. 2000, pp. 217-221.
John Gooding, "Microchannel heat exchangers—a review", SPIE vol. 1997 High Heat Flux Engineering II (1993), pp. 66-82.
Koichiro Kawano et al., "Micro Channel Heat Exhanger for Cooling Electrical Equipment", HTD-vol. 361-3/PID-vol. 3, Proceedings of the ASME Heat Transfer Division—vol. 3, ASME 1998, pp. 173-188.
Chad Harris et al., "Design and Fabrication of a Cross Flow Micro Heat Exchanger", Dec. 2000, Journal of Microelectromechanical Systems, vol. 9, No. 4, pp. 502-508.
George M. Harpole et al., "Micro-Channel Heat Exchanger Optimization", 1991, Seventh IEEE Semi-Therm Symposium, pp. 59-63.
Pei-Xue Jiang et al., "Thermal-hydraulic performance of small scale micro-channel and porous media heat-exchangers", International Journal of Heat and Mass Transfer 44 (2001), pp. 1039-1051.
X.N. Jiang et al., "Laminar Flow Through Microchannels Used for Microscale Cooling Systems", 1997, IEEE/CPMT Electronic Packaging Technology Conference, pp. 119-122.
David Bazeley Tuckerman, "Heat-Transfer Microstructures for Integrated Circuits", Feb. 1984, pp. ii-xix, pp. 1-141.
M Esashi, "Silicon micromachining for integrated microsystems", Vacuum/vol. 47/ Nos. 6-8/pp. 469-474.
T.S. Raviguruajan et al., "Effects of Heat Flux on Two-Phase Flow Characteristics of Refrigerant Flows in a Micro-Channel Heat Exchanger", HTD-vol. 329, National Heat Transfer Conference, vol. 7, ASME 1996, pp. 167-178.
T.S. Ravigruruajan et al., "Single-Phase Flow Thermal Performance Characteristics of a Parallel Micro-Channel Heat Exchanger", 1996, HTD-vol. 329, National Heat Transfer Conference, vol. 7, ASME 1996, pp. 157-166.
T.S. Raviguruajan et al., "Liquid Flow Characteristics in a Diamond-Pattern Micro-Heat-Exchanger", DSC-vol. 59 Microelectromechanical Systems (MEMS), ASME 1996, pp. 159-166.
T.S. Raviguruajan, "Impact of Channel Geometry on Two-Phase Flow Heat Transfer Characteristics of Refrigerants in Microchannel Heat Exchangers", May 1998, Journal of Heat Transfer, vol. 120, pp. 485-491.
J. Pfahler et al., "Liquid Transport in Micron and Submicron Channels", Mar. 1990, Sensors and Actuators, A21-A23 (1990), pp. 431-434.
Kenneth Pettigrew et al., "Performance of a MEMS based Micro Capillary Pumped Loop for Chip-Level Temperature Control", 2001, The 14th IEEE International Conference on Micro Electro Mechanical Systems, pp. 427-430.
C. Perret et al., "Microchannel integrated heat sinks in silicon technology", Oct. 12-15, 1998, The 1998 IEEE Industry Applications Conference, pp. 1051-1055.
X.F. Peng et al., "Convective heat transfer and flow friction for water flow in microchannel structures", 1996, Int. J. Heat Mass Transfer, vol. 39, No. 12, pp. 2599-2608, printed in Great Britain.
X.F. Peng et al., "Experimental investigation of heat transfer in flat plates with rectangular microchannels", 1994, Int. J. Heat Mass Transfer, vol. 38, No. 1, pp. 127-137, printed in Great Britain.
X.F. Peng et al., "Cooling Characteristics with Microchanneled Structures", 1994, Enhanced Heat Transfer, vol. 1, No. 4, pp. 315-326, printed in the United States of America.
X.F. Peng et al., "Enhancing the Critical Heat Flux Using Microchanneled Surfaces", 1998, Enhanced Heat Transfer, vol. 5, pp. 165-176, Printed in India.
Yoichi Murakami et al., "Parametric Optimization of Multichanneled Heat Sinks for VLSI Chip Cooling", Mar. 2001, IEEE Transactions on Components and Packaging Technologies, vol. 24, No. 1, pp. 2-9.
D. Mundinger et al., "High average power 2-D laser diode arrays on silicon microchannel coolers", CLEO '89/Friday Morning/404.
L.J. Missaggia et al., "Microchannel Heat Sinks for Two-Dimensional High-Power-Density Diode Laser Arrays", 1989, IEEE Journal of Quantum Electronics, vol. 25, No. 9, Sep. 1989, pp. 1988-1992.
M.J. Marongiu et al., "Enhancement of Multichip Modules (MCMs) Cooling by Incorporating MicroHeatPipes and Other High Thermal Conductivity Materials into Microchannel Heat Sinks", 1998, Electronic Components and Technology Conference, pp. 45-50.
C.R. Friedrich et al., "Micro heat exchangers fabricated by diamond machining", Jan. 1994, Precision Engineering, vol. 16, No. 1, pp. 56-59.
Mali Mahalingam, "Thermal Management in Semiconductor Device Packaging", Proceedings of the IEEE, vol. 73, No. 9, Sep. 1985, pp. 1396-1404.
T.M. Adams et al., "An experimental investigation of single-phase forced convection in microchannels", 1997, Int. J. Heat Mass Transfer, vol. 41, Nos. 6-7, pp. 851-857, Printed in Great Britain.
T.M. Adams et al., "Applicability of traditional turbulent single-phase forced convection correlations to non-circular microchannels", 1999, Int. J. Heat and Transfer 42 (1999), pp. 4411-4415.
Bassam Badran et al., "Experimental Results for Low-Temperature Silicon Micromachined Micro Heat Pipe Arrays Using Water and Methanol as Working Fluids", May 31, 1997, Experimental Heat Transfer, 10: pp. 253-272.
D. Jed Harrison et al., "Electroosmotic Pumping Within A Chemical Sensor System Integrated on Silicon", Session C9 Chemical Sensors and Systems for Liquids, Jun. 26, 1991, pp. 792-795.
Kurt Seller et al., "Electroosmotic Pumping and Valveless Control of Fluid Flow within a Manifold of Capillaries on a Glass Chip", 1994, Analytical Chemistry, vol. 66, No. 20, Oct. 15, 1994, pp. 3485-3491.
Philip H. Paul et al., "Electrokinetic Generation of High Pressures Using Porous Microstructures", 1998, Micro-Total Analysis Systems, pp. 49-52.

Gh. Mohiuddin Mala et al., "Flow characteristics of water through a microchannel between two parallel plates with electrokinetic effects", Oct. 1997, Int. J. Heat and Fluid Flow, vol. 18, No. 5, pp. 489-496.
W.E. Morf et al., "Partial electroosmotic pumping in complex capillary systems Part 1: Principles and general theoretical approach", Oct. 16, 2000, Sensors and Actuators B 72 (2001), pp. 266-272.
M. Esashi, "Silicon micromachining and micromachines", Wear, vol. 168, No. 1-2, (1993), pp. 181-187.
Stephanus Buttgenbach et al., "Microflow devices for miniaturized chemical analysis systems", Nov. 1998, SPIE-Chemical Microsensors and Applications, vol. 3539, pp. 51-61.
Sarah Arunlanandam et al., "Liquid transport in rectangular microchannels by electroosmotic pumping", Colloids and Surfaces A: Physicochemical and Engineering Aspects, vol. 161 (2000), pp. 89-102.
Linan Jiang et al., "Closed-Loop Electroosmotic Microchannel Cooling System for VLSI Circuits", Mechanical Engineering Dept. Stanford University, pp. 1-27.
Susan L. R. Barker et al., "Fabrication, Derivatization and Applications of Plastic Microfluidic Devices", Proceedings of SPIE, vol. 4205, 2000, pp. 112-118.
Timothy E. McKnight et al., "Electroosmotically Induced Hydraulic Pumping with Integrated Electrodes on Microfluidic Devices", Aug. 15, 2001, Anal. Chem., vol. 73, No. 16, pp. 4045-4049.
Chris Bourne, "Cool Chips plc Receives Nanotech Manufacturing Patent", Jul. 31, 2002, pp. 1-2.
Frank Wagner et al., "Electroosmotic Flow Control in Micro Channels Produced by Scanning Excimer Laser Ablation", Proceedings of SPIE vol. 4088, 2000, pp. 337-340.
H. A. Goodman, "Data Processor Cooling With Connection To Maintain Flow Through Standby Pump", Dec. 1983, IBM Technical Disclosure Bulletin, vol. 26, No. 7A, p. 3325.
"Electroerosion Micropump", May 1990, IBM Technical Disclosure Bulletin, vol. 32, No. 12, pp. 342-343.
Shulin Zeng et al., "Fabrication and Characterization of Electrokinetic Micro Pumps", 2000 Inter Society Conference on Thermal Phenomena, pp. 31-35.
A. Manz et al., "Integrated Electroosmotic Pumps and Flow Manifolds for Total Chemical Analysis Systems", 1991, Inter. Conf. on Solid-State Sensors and Actuators, pp. 939-941.
O. T. Guenat et al., "Partial electroosmotic pumping in complex capillary systems Part: 2 Fabrication and application of a micro total analysis system suited for continuous volumetric nanotitrations", Sensors and Actuators B 72 (2001) pp. 273-282.
J. G. Sunderland, "Electrokinetic dewatering and thickening. I. Introduction and historical review of electrokinetic applications", Feb. 1987, Journal of Applied Electrochemistry, vol. 17, No. 5, pp. 889-898.
J. C. Rife et al., "Acousto- and electroosmotic microfluidic controllers", Sep. 1998, Microfluidic Devices and Systems, vol. 3515, pp. 125-135.
Purnendu K. Dasgupta et al., "Electroosmosis: A Reliable Fluid Propulsion System for Flow Injection Analysis", Jun. 1994, Anal. Chem., vol. 66, No. 11, pp. 1792-1798.
Ray Beach et al., "Modular Microchannel Cooled Heatsinks for High Average Power Laser Diode Arrays", Apr. 1992, IEEE Journal of Quantum Electronics, vol. 28, No. 4, pp. 966-976.
Roy W. Knight et al., "Optimal Thermal Design of Air cooled Forced Convection Finned Heat Sinks—Experimental Verification", Oct. 1992, IEEE Transactions on Components, Hybrids, and Manufacturing Technology, vol. 15, No. 5, pp. 754-760.
Y. Zhuang et al., "Experimental study on local heat transfer with liquid impingement flow in two-dimensional micro-channels", 1997, Int. J. Heat Mass Transfer, vol. 40, No. 17, pp. 4055-4059.
D. Yu et al., "An Experimental and Theoretical Investigation of Fluid Flow and Heat Transfer in Microtube", 1995, ASME / JSME Thermal Engineering Conference, vol. 1, pp. 523-530.
Xiaoqing Yin et al., "Micro Heat Exchangers Consisting of Pin Arrays", Journal of Electronic Packaging, Mar. 1997, vol. 119, pp. 51-57.
X. Yin et al., "Uniform Channel Micro Heat Exchangers", Journal of Electronic Packaging, Jun. 1997, vol. 119, pp. 89-94.
Chun Yang et al., "Modeling forced liquid convection in rectangular microchannels with electrokinetic effects", International Journal of Heat and Mass Transfer 41 (1998), pp. 4229-4249.
Arel Weisberg et al., "Analysis of microchannels for integrated cooling", 1992, Int. J. Heat Mass Transfer, vol. 35, No. 10, pp. 2465-2473.
Roger S. Stanley et al., "Two-Phase Flow in Microchannels", 1997, DSC-vol. 62/HTD-vol. 354, MEMS, pp. 143-152.
B. X. Wang et al., "Experimental investigation on liquid forced-convection heat transfer through microchannels", 1994, Int. J. Heat Mass Transfer, vol. 37, Suppl. 1, pp. 73-82.
Kambiz Vafai et al., "Analysis of two-layered micro-channel heat sink concept in electronic cooling", Int. J. Heat Mass Transfer, 42 (1999), pp. 2287-2297.
Gokturk Tunc et al., "Heat transfer in rectangular microchannels", Int. J. Heat Mass Transfer, 45 (2002), pp. 765-773.
D. B. Tuckerman et al., "High-Performance Heat Sinking for VLSI", May 1981, IEEE Electronic Device Letters, vol. EDL-2, No. 5, pp. 126-129.
Bengt Sunden et al., "An Overview of Fabrication Methods and Fluid Flow and Heat Transfer Characteristics of Micro Channels", pp. 3-23.
David S. Shen et al., "Micro Heat Spreader Enhanced Heat Transfer in MCMs", 1995, IEEE Multi-Chip Module Conference, pp. 189-194.
S. Sasaki et al., "Optimal Structure for Microgrooved Cooling Fin for High-Power LSI Devices", Electronic Letters, Dec. 4, 1986, vol 22, No. 25.
Vijay K. Samalam, "Convective Heat Transfer in Microchannels", 1989, Journal of Electronic Materials, vol. 18, No. 5, pp. 611-617.
Sanjay K. Roy et al., "A Very High Heat Flux Microchannel Heat Exchanger for Cooling of Semiconductor Laser Diode Arrays", May 1996, IEEE Transactions on components, packaging, and manufacturing technology-part B, vol. 19, No. 2, pp. 444-451.
Charlotte Gillot et al., "Integrated Single and Two-Phase Micro Heat Sinks Under IGBT Chips", IEEE Transactions on Components and Packaging Technology, vol. 22, No. 3, Sep. 1999, pp. 384-389.
A.L. Pascuzzo et al., "Integrated Circuit Module Package Cooling Structure", IBM, vol. 20, No. 10, Mar. 1978, pp. 3898-3899.
H. Krumm, "Chip Cooling", IBM Technical Disclosure Bulletin, vol. 20, No. 7, Dec. 1977, p. 2728.
Jae-Mo Koo et al., "Modeling of Two-Phase Microchannel Heat Sinks for VLSI Chips", Mech. Eng. Depart. of Stanford University, pp. 422-426.
"Thermal-Hydraulic Performance of Small Scaled Micro-Channel and Porous -Media Heat Exchangers", Pei-Xue Jiang et al., pp. 1039-1051. Department of Thermal Engineering, revised Feb. 21, 2000.

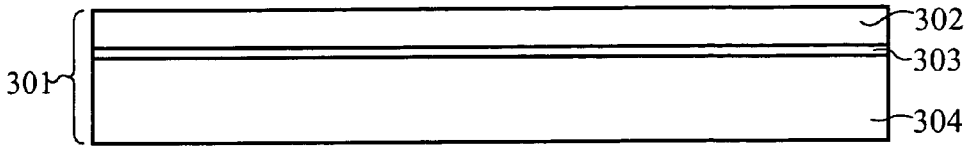
Fig. 3A
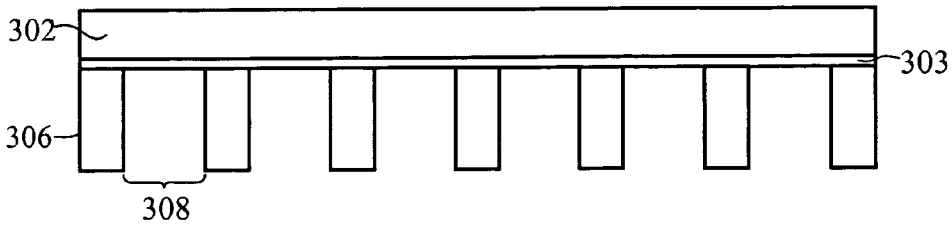
Fig. 3B
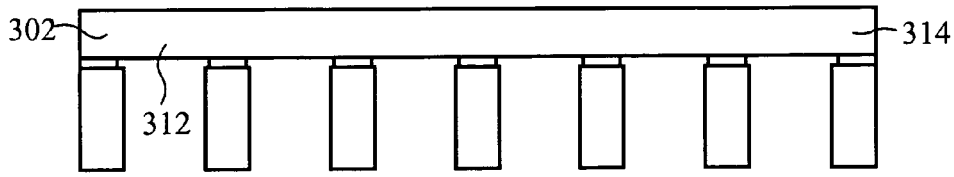
Fig. 3C
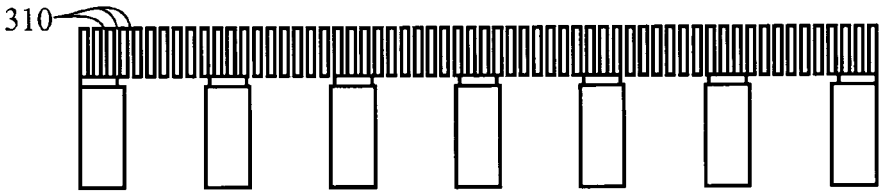
Fig. 3D
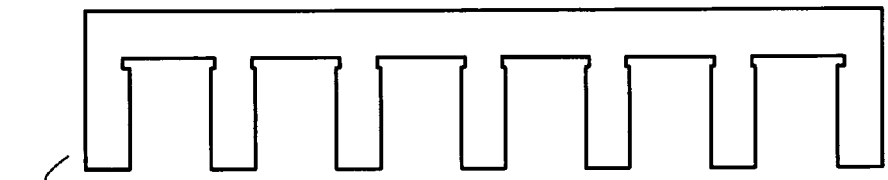
Fig. 3E
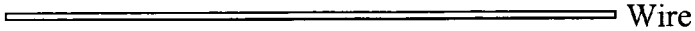
Fig. 3F
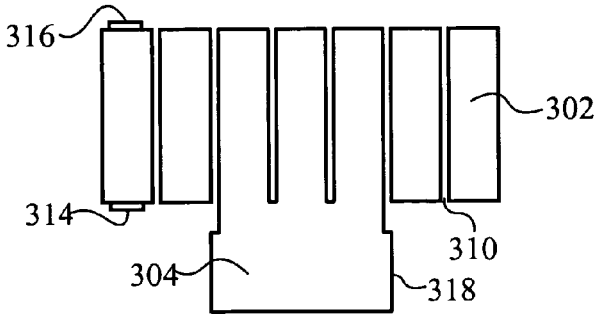

MICRO-FABRICATED ELECTROKINETIC PUMP

RELATED APPLICATION

This patent application is a divisional of U.S. patent application Ser. No. 10/366,121 filed Feb. 12, 2003, now U.S. Pat. No. 6,881,039 the contents of which are hereby incorporated by reference.

The parent U.S. patent application Ser. No. 10/366,121 claims priority under 35 U.S.C. 119(e) of the co-pending U.S. Provisional Patent Application Ser. No. 60/413,194 filed Sep. 23, 2002, and entitled "MICRO-FABRICATED ELECTROKINETIC PUMP". The Provisional Patent Application Ser. No. 60/413,194 filed Sep. 23, 2002, and entitled "MICRO-FABRICATED ELECTROKINETIC PUMP" is also hereby incorporated by reference.

FIELD OF THE INVENTION

The present invention relates to an apparatus for cooling and a method thereof. In particular, the apparatus is for an improved electrokinetic pump having substantially straight and very small pore apertures and lengths. The pump is manufactured by a process using semiconductor processing techniques.

BACKGROUND OF THE INVENTION

High density integrated circuits have evolved in recent years including increasing transistor density and clock speed. The result of this trend is an increase in the power density of modern microprocessors, and an emerging need for new cooling technologies. At Stanford, research into 2-phase liquid cooling began in 1998, with a demonstration of closed-loop systems capable of 130 W heat removal. One key element of this system is an electrokinetic pump, which was capable of fluid flow on the order of ten of ml/min against a pressure head of more than one atmosphere with an operating voltage of 100V.

This demonstration was all carried out with liquid-vapor mixtures in the microchannel heat exchangers because there was insufficient liquid flow to capture all the generated heat without boiling. Conversion of some fraction of the liquid to vapor imposes a need for high-pressure operation, and increases the operational pressure requirements for the pump. Furthermore, two phase flow is less stable during the operation of a cooling device and can lead to transient fluctuations and difficulties in controlling the chip temperature. The pump in that demonstration was based on porous glass filters that are several mm thick. A disadvantage of these structures is that the pore density, structure, and mean diameter is not uniform and also not easily reproduced in a low-cost manufacturing process. Furthermore, the fluid path in these structures is highly tortuous, leading to lower flow rates for a given thickness of pump. Porous ceramic structures with nominally the same character were shown to exhibit pumping characteristics which varied by large amounts.

What is needed is an electrokinetic pumping element that would provides a relatively large flow and pressure within a compact structure and offer much better uniformity in pumping characteristics.

SUMMARY OF THE INVENTION

An electrokinetic pump for pumping a liquid includes a pumping body having a predetermined thickness, preferably in the range of 10 microns and 1 millimeter. The body includes a plurality of pore apertures for channeling the liquid through the body, wherein each pore aperture extends from the first outer surface to the second outer surface and are preferably 0.1-2.0 microns in diameter. The pores are preferably narrow, short and straight. The pumping body is preferably oxidized. A pair of electrodes for applying a voltage differential are formed on opposing surfaces of the pumping body at opposite ends of the pore apertures. The pumping body is formed on a support structure to maintain a mechanical integrity of the pumping body.

A method of fabricating an electrokinetic pump preferably uses conventional semiconductor processing techniques and includes providing a first material for a pumping body having a first surface and a second surface. A plurality of pore apertures are formed through the first material. The pumping body including the interior of the pore apertures is oxidized. An electrode is formed on the first and second surfaces. A voltage potential is coupled across the electrodes to move a liquid to flow through the plurality of pore apertures.

Another method of fabricating an electrokinetic pump includes providing a substrate having a first surface. A plurality of etch stop alignment marks is formed on the first surface. A pumping element material is formed on the first surface. A plurality of pore apertures are formed through the pumping material. A support structure is formed under the etch stop alignment marks by removing remaining material. The resulting structure is oxidized including within the pore apertures wherein a voltage differential applied across the pumping element drives liquid through the plurality of capillaries.

Other features and advantages of the present invention will become apparent after reviewing the detailed description of the preferred embodiments set forth below.

BRIEF DESCRIPTION OF THE DRAWINGS

FIGS. 3A-3F illustrates a preferred method of fabricating the pump of the preferred embodiment of the present invention.

FIG. 3A illustrates a first step in fabricating the pump of the preferred embodiment.

FIG. 3B illustrates a second step in fabricating the pump of the preferred embodiment.

FIG. 3C illustrates a third step in fabricating the pump of the preferred embodiment.

FIG. 3D illustrates a fourth step in fabricating the pump of the preferred embodiment.

FIG. 3E illustrates a fifth step in fabricating the pump of the preferred embodiment.

FIG. 3F illustrates a sixth step in fabricating the pump of the preferred embodiment.

FIG. 4A illustrates a first step in an alternative method of fabricating the pump of the preferred embodiment.

FIG. 4B illustrates a second step in an alternative method of fabricating the pump of the preferred embodiment.

FIG. 4C illustrates a third step in an alternative method of fabricating the pump of the preferred embodiment.

FIG. 4D illustrates a fourth step in an alternative method of fabricating the pump of the preferred embodiment.

FIG. 4E illustrates a fifth step in an alternative method of fabricating the pump of the preferred embodiment.

FIG. 4F illustrates a sixth step in an alternative method of fabricating the pump of the preferred embodiment.

FIG. 4G illustrates a seventh step in an alternative method of fabricating the pump of the preferred embodiment.

FIG. 4H illustrates a eighth step in an alternative method of fabricating the pump of the preferred embodiment.

FIG. 5A illustrates a first step in another alternative method of fabricating the pump of the preferred embodiment.

FIG. 5B illustrates a second step in another alternative method of fabricating the pump of the preferred embodiment.

FIG. 5C illustrates a third step in another alternative method of fabricating the pump of the preferred embodiment.

FIG. 5D illustrates a fourth step in another alternative method of fabricating the pump of the preferred embodiment.

DETAILED DESCRIPTION OF THE PREFERRED EMBODIMENT

Figure 1A:
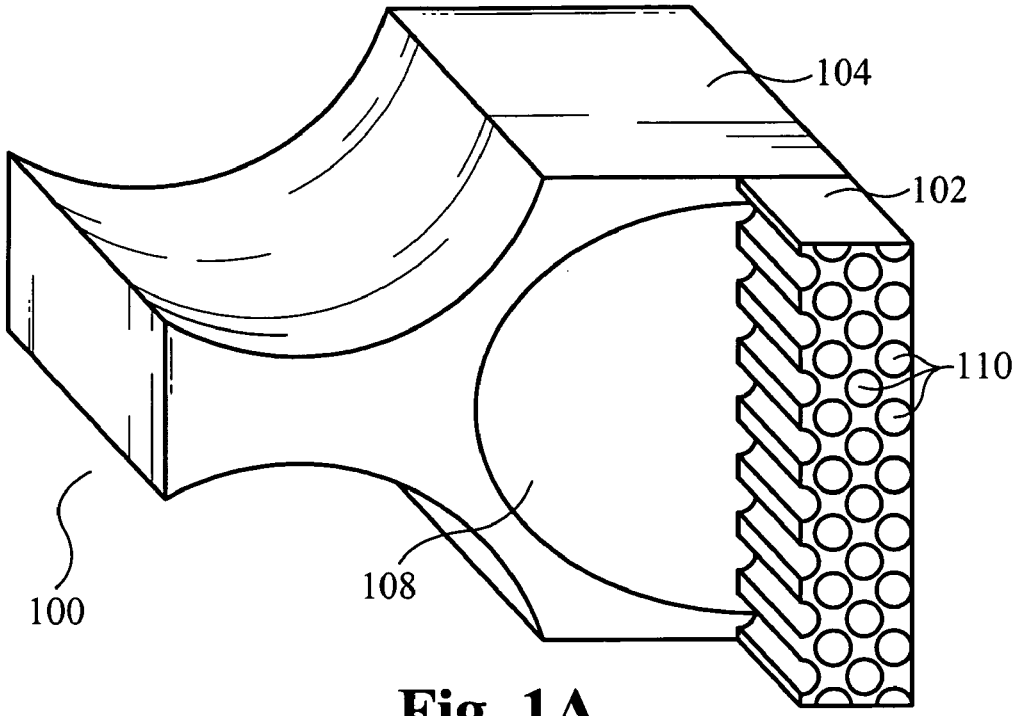
FIG. 1A illustrates a perspective view of the pumping element of the preferred embodiment of the present invention.

Reference will now be made in detail to the preferred and alternative embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it should be noted that the present invention may be practiced without these specific details. In other instances, well known methods, procedures, components, and circuits have not been described in detail as not to unnecessarily obscure aspects of the present invention.

The basic performance of an electrokinetic or electro-osmotic pump is modeled by the following relationships:

$$Q = \frac{\Psi\varsigma}{\tau}\frac{\varepsilon VA}{\mu L}\left(1 - \frac{2\lambda I_1(a/\lambda_D)}{aI_o(a/\lambda_D)}\right) \quad (1)$$

$$\Delta P = \frac{8\varepsilon\varsigma V}{a^2}\left(1 - \frac{2\lambda I_1(a/\lambda_D)}{aI_o(a/\lambda_D)}\right) \quad (2)$$

As shown in equations (1) and (2), Q is the flow rate of the liquid flowing through the pump and ΔP is the pressure drop across the pump and the variable a is the diameter of the pore aperture. In addition, the variable ψ is the porosity of the pore apertures, ζ is the zeta potential, ϵ is the permittivity of the liquid, V is the voltage across the pore apertures, A is the total Area of the pump, τ is the tortuosity, μ is the viscosity and L is the thickness of the pumping element. The terms in the parenthesis shown in equations (1) and (2) are corrections for the case in which the pore diameters approach the size of the charged layer, called the Debye Layer, $\lambda_D$, which is only a few nanometers. For pore apertures having a diameter in the 0.1 mm range, these expressions simplify to be approximately:

$$Q = \frac{\Psi\varsigma}{\tau}\frac{\varepsilon VA}{\mu L} \quad (3)$$

$$\Delta P = \frac{8\varepsilon\varsigma V}{a^2} \quad (4)$$

As shown in equations (3) and (4). The amount of flow and pressure are proportional to the amount of voltage potential that is present. However, other parameters are present that affect the performance of the pump. For example, the tortuosity (τ) describes the length of a channel relative to the thickness of the pumping element and can be large for pumps with convoluted, non-parallel channel paths. The length (L) is the thickness of the pumping element. As shown in equations (3) and (4), the tortuosity τ and thickness L of the pumping element are inversely proportional to the flow equation (4) without appearing at all in the pressure equation (4). The square of the diameter a of the pore apertures is inversely proportional to the pressure equation (4) without appearing at all in the flow equation (3).

The pump of the present invention operates at significantly reduced voltages in relation to the prior electrokinetic pumps, but still generate the same or more flow without significant reductions in pressure. Existing pumps have average pore aperture diameters in the range of 0.8 to 1.2 microns. In addition, existing ceramic pump elements have thicknesses of 3-4 mm and a tortuosity of 1.4-2.0. A typical prior electrokinetic pump having a thickness of 2.5 mm produces flow of 25 ml/min at a voltage of 100 V and have a max pressure of 1.00 Atm.

In contrast, the thickness of the pumping element is reduced by 100 times; the tortuosity is improved by a factor of more than 3; and the pore diameter is reduced by 3 times. The reduction in these three factors allows the pump of the present invention to be operated at 10 times reduced voltage and yet be capable of more than 10 times more flow. The pump of the present invention is able to perform under such conditions by reduction: in the diameter of the pore aperture; the thickness of the pumping element; and the tortuosity of the pump apertures.

Figure 1B:
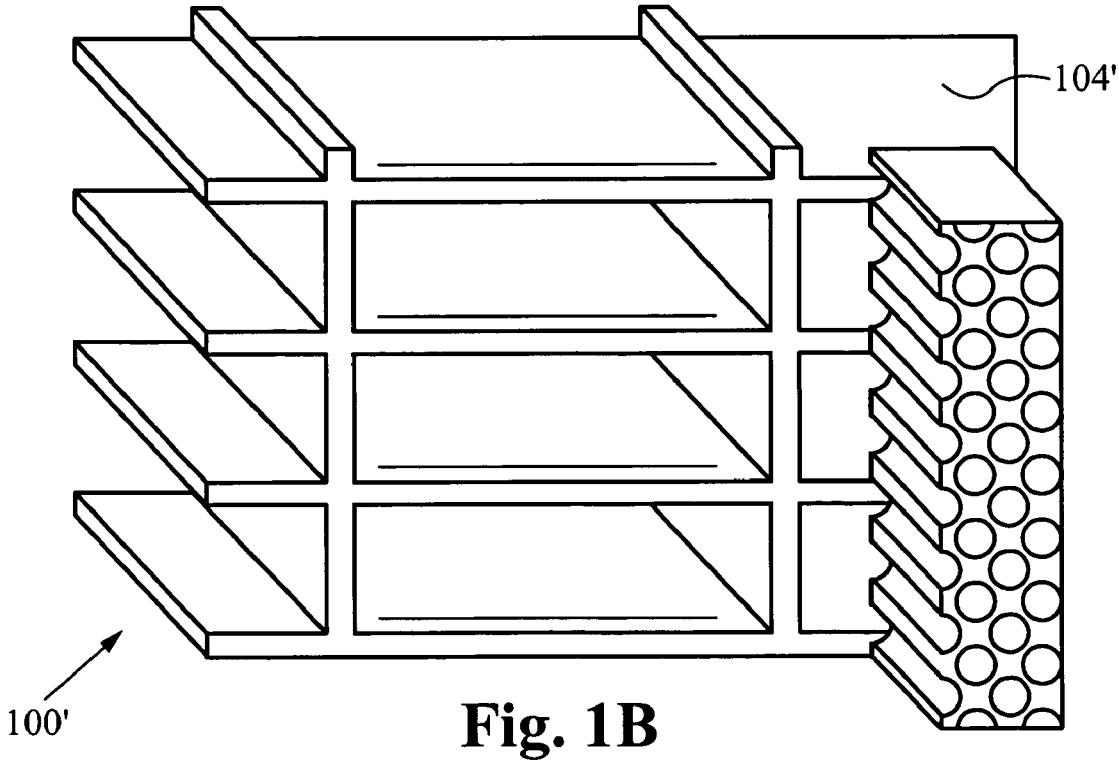
FIG. 1B illustrates a perspective view of the pumping element of an alternative embodiment of the present invention.
Figure 2:
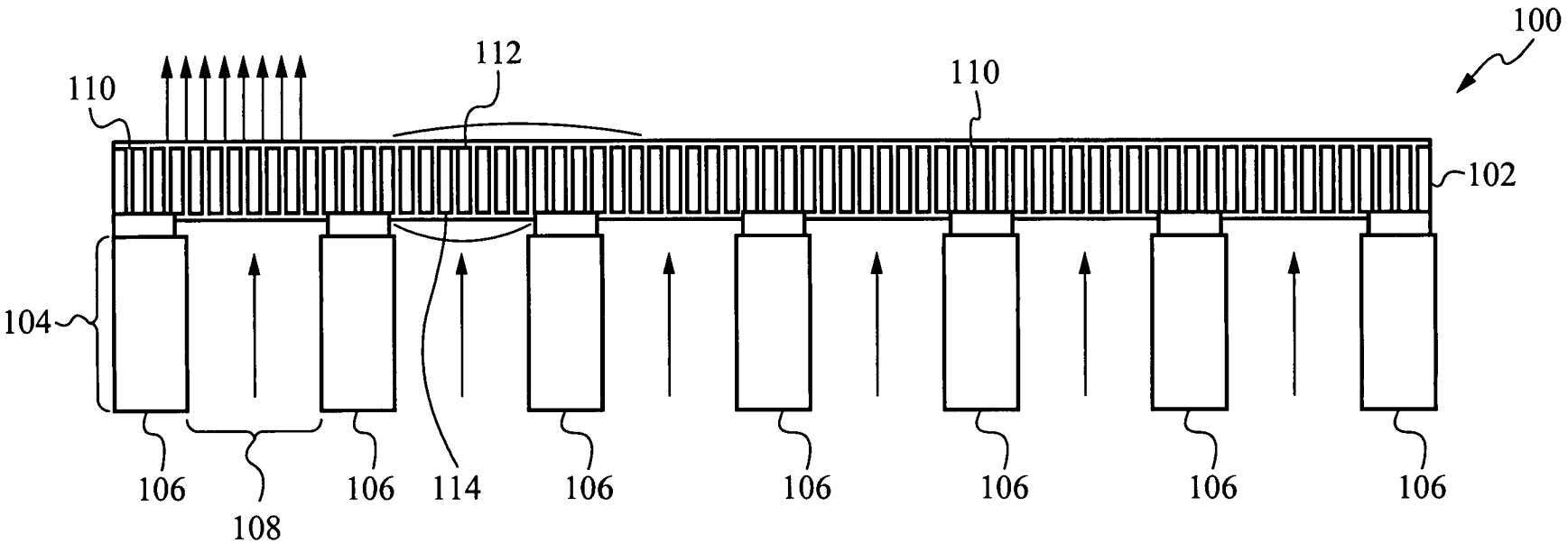
FIG. 2 illustrates a cross sectional view of the pump of the preferred embodiment of the present invention.

FIG. 1A illustrates a preferred embodiment of the pump 100 in accordance with the present invention. The pump 100 includes a pumping element or body 102 and a support element 104. Preferably, the pumping element 102 includes a thin layer of silicon with a dense array of cylindrical holes, designated as pore apertures 110. Alternatively, the pumping element 102 is made of any other appropriate material. It is preferred that the pumping element has a thickness range of 10 microns to 1 millimeter and the pore apertures 110 have a diameter of 0.1-2.0 microns. As shown in FIGS. 1 and 2, the pumping element 102 is supported by the support element 104 having a less dense array of much larger holes or support apertures 108. The support element 104 provides mechanical support to the pumping element 102 and a thickness of at least 300 microns. Preferably the support element 104 has a thickness of 400 microns whereby the support apertures 108 are at least 100 microns in diameter, although other thicknesses are contemplated. The illustration of the support structures 108 in FIG. 1A is only one type of configuration and it should be noted that other geometric structures can alternatively be used to balance mechanical strength with ease of fabrication. Such alternative structures include a honeycomb lattice of material, a square lattice of material, a spiderweb-lattice of material, or any other structural geometry that balances mechanical strength with ease of fabrication. FIG. 1B illustrates an example of a square lattice structure 100'.

FIG. 2 illustrates a cross sectional view of the pump 100 of the present invention. As shown in FIG. 2, the pumping element 102 includes a dense array of pore apertures 110 and the support element 104 attached to the pumping element 102, whereby the support element 104 includes an array of support structures 106. The pore apertures 110 pass through the pumping element 102 from its bottom surface 114 to its top surface 112. In particular, the pore apertures 110 channel liquid from the bottom surface 114 to the top surface 112 of the pumping element 102, as shown in FIG. 2. Preferably, the liquid used in the pump 100 of the present invention is water with an ionic buffer to control the pH and conductivity of the liquid. Alternatively, other liquids may be used including, but not limited to, acetone, acetonitrile, methanol, alcohol, ethanol, water having other additives, as well as mixtures thereof. It is contemplated that any other suitable liquid is contemplated in accordance with the present invention.

The support structures 106 are attached to the pumping element 102 at predetermined locations to the bottom surface 114 of the pumping element 102. These predetermined locations are dependent on the required strength of the pump 100 in relation to the pressure differential and flow rate of the liquid passing through the pumping element 102. In between each support structure 106 is a support aperture 108, whereby the liquid passes from the support apertures 108 into the pore apertures 110 in the bottom surface 114 of the pumping element 102. The liquid then flows from the bottom pore apertures 110 through the channels of each pore apertures and exits through the pore apertures 110 opening in the top surface 112 of the pumping element 102. Though the flow is described as liquid moving from the bottom surface 114 to the top surface 112 of the pumping element 102, it will be apparent that reversing the voltage will reverse of the flow of the liquid in the other direction.

The liquid passes through the pumping element 102 under the process of electro-osmosis, whereby an electrical field is applied to the pumping element 102 in the form of a voltage differential. Preferably, electrodes 316 (FIG. 3F) are placed at the top surface 112 and bottom surface 114 of the pumping element 102, whereby the voltage differential between the top surface 112 and the bottom surface 114 drives the liquid from the support apertures 108 up through the pore apertures 110 and out through top surface 112 of the pumping element 102. Alternatively, the electrodes 316 are applied a predetermined distance away from the top surface 112 and bottom surface 114 of the pumping element 102. Although the process of electro-osmosis is briefly described here, the process is well known in the art and will not be described in any more detail.

Figure 5A:
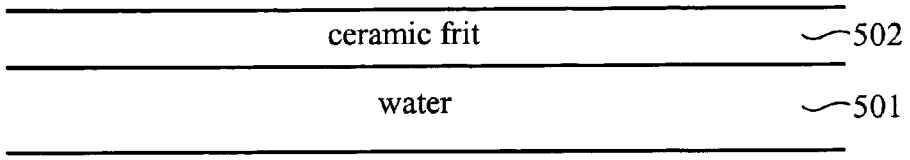
FIGS. 5A-5D illustrates another alternative method of fabricating the pump in accordance with the present invention.
Figure 5B:
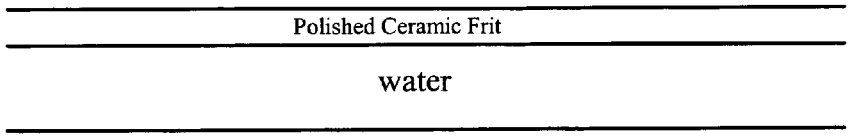

Preferably, as shown in FIG. 2, the pore apertures in the pumping element are short (10-20 microns), straight, and narrow (0.2-0.5 microns). Alternatively, the pore apertures are non-parallel and are not straight, as shown in FIG. 5B. The configuration of the pore apertures 110 allows the pump of the present invention to produce a relatively large amount flow and pressure with a much lower required voltage than prior art electrokinetic pumps.

It is theorized that, the flow rate and pressure differential increases are due to the reduction in the pore diameter a, tortuosity $\tau$, and thickness in the pumping element 102. This is shown with regard to equations (3) and (4). As shown in equation (3), the reduction in tortuosity $\tau$ in the pore apertures 110 increases the overall flow rate of the liquid passing through the pore apertures 110. In addition, the reduction in thickness, L, of the pumping element 102 also increases the overall flow rate of the liquid passing through the pore apertures according to equation (3). Further, as shown in equation (4), reduction of the pore aperture diameter a substantially increases the amount of pressure differential of the liquid flowing through the pumping element 102. Although the flow rate, Q, and pressure differential, $\Delta P$, increase due to the configuration of the present pump 100, the flow rate and pressure differential can be maintained at a suitable amount while reducing the voltage required to operate the pump 100 accordingly.

The pump of the present invention can be fabricated in several different ways. FIGS. 3A-3F illustrates the preferred embodiment of fabricating the pump 300 in accordance with the present invention. As shown in FIGS. 3A-3F, the pump is made by a series of lithographic/etching steps, such as those used in conventional integrated circuit manufacturing. In the preferred embodiment, a substrate wafer is provided 302, whereby the wafer is preferably a SOI wafer, as shown in FIG. 3A. Alternatively, the wafer is made of standard silicon substrate with pre-formed layers of oxide and polysilicon. Alternatively, as discussed below, a combination of oxide and nitride patterns is used instead of the oxide layer, whereby the combination layer offers differing resistance to the etching process. In such a case, the etching step can be carried out without a carefully-timed termination, producing a bond layer with easily-controlled dimensions.

As shown in FIGS. 3A-3F, the preferred process of fabricating the pump 300 proceeds with forming the support structures 306 and support apertures 308 by patterning and etching the features in the support element 304, as shown in FIG. 3B. The pattern FIG. 3B preferably uses conventional photo resist deposit, expose, develop and pattern steps. Because the use of photo resist to form predetermined patterns is well known, such steps will not be discussed herein. In FIG. 3C, hydrofluoric acid etching is performed on the wafer 301 to clear any oxide 303 located between the support structures 306 and the bottom surface 312 of the pumping element 302. It is appropriate that the HF etch step be properly timed to be sufficiently long to allow the exposure of the surface of the pumping element adjacent the support structures 306 to be exposed but not be excessively long to prevent the pumping element 302 from separating from the support structures 306.

In FIG. 3D, shown in FIG. 3, the pore apertures 310 and corresponding channels are formed by a plasma etching technique. The plasma etching technique forms the pore apertures 310 to preferably be parallel and straight.

Once the pore apertures 310 are formed, a diffusion oxidation step is performed on the pump 300 whereby all surfaces of the pump 300, including surfaces of the pumping element 302 and support element 304 are oxidized with an oxide layer 318. The oxide layer 318, preferably $SiO_2$, forms a passivation oxide which prevents current from bypassing the electrokinetic osmotic pumping effect caused by the voltage differential between the openings of the pore apertures 310. In addition, the step of growing the oxide layer 318 serves to narrow the channels of the pore apertures 310, because SiO2 forms from oxidized silicon at a high-temperature with $O_2$ gas, as shown in FIG. 3F Thus, narrower pore apertures can be formed by this oxidation step than can be etched photo lithographically using a plasma etch. In one embodiment, the pore apertures are less than 0.4 μm in diameter after the oxide is formed, whereby the pumping element 302 has a high porosity due to the dense amount of pore apertures 310 within.

The support element 304 has large support apertures 308 which offer very little resistance to the flow of liquid through the pump body 302 while still providing adequate structural support. Therefore, the formation of 0.25 microns of this oxide in a silicon pore with a diameter of 1 micron serve to reduce the pore diameter to almost 0.5 microns. This process can be carried out with excellent thickness control, as the growth of gate oxides in silicon is very thoroughly characterized and determinable in the art. As a final step, an electrode is formed on both surfaces of the pumping element 102. Details concerning the electrodes are discussed below.

Figure 4A:
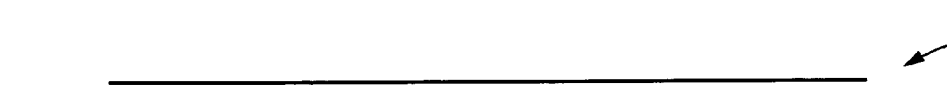
FIGS. 4A-4H illustrates an alternative method of fabricating the pump in accordance with the present invention.
Figure 4B:
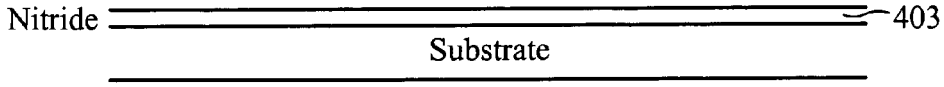
Figure 4C:
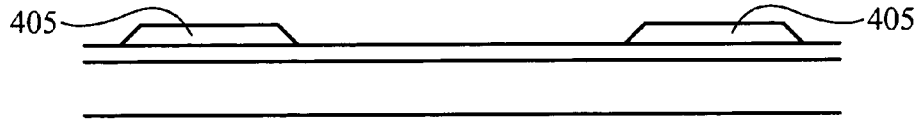

FIGS. 4A-4H illustrates an alternative process of fabricating the electrokinetic pump 400 in accordance with the present invention. The alternative process in FIGS. 4A-4H is designed such that the HF etch step is self-terminated. Because this step self-terminates, this alternative process eliminates any timing issues regarding attachment of the support structures 406 to the pumping element 402. The alternative process begins with providing a standard silicon wafer or substrate 401, as shown in FIG. 4A. The next step includes forming a bond layer by depositing a predetermined amount of bonding material 403 such as 0.5 microns of Silicon Nitride, onto the top surface of the substrate 401, as shown in FIG. 4B. Alternatively, any other appropriate bonding material is used instead of Silicon Nitride. The Silicon Nitride layer is then patterned and etched from the top surface of the substrate 401 at predetermined locations dependent on the structure support required for the pump 400. Once etched, the remaining portions of the bonding material 403 are used as alignment marks 405 to align the support structures 406 to their appropriate locations, as shown in FIG. 4C. In addition, a Chemical-Mechanical Polishing (CMP) process is optionally carried out to smooth the upper surface of the bonding material 403.

Figure 4D:
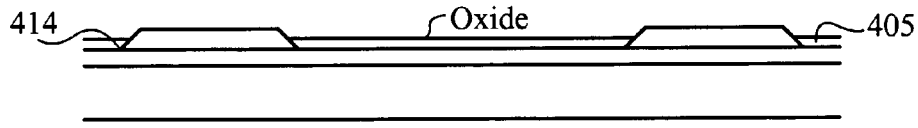
Figure 4E:
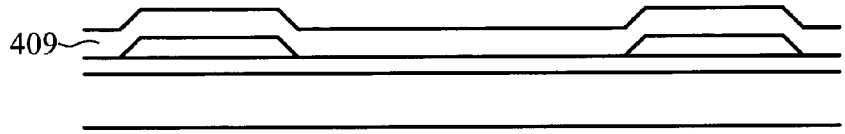

As shown in FIG. 4D, in FIG. 4, an oxide layer 407 is applied to the top surface 414 of the substrate 401, whereby the oxide layer 407 is grown over the alignment marks 405. Alternatively, the oxide layer 407 is applied at a thickness less than the height of the alignment marks 405, whereby the oxide layer 407 is not applied over the alignment marks 405. The polysilicon layer 409 is formed on the surface oxide layer 407 and is used to form the pumping element 402, as shown in FIGS. 4E and 4F. The polysilicon layer 409 preferably grows in an epitaxial process. Preferably, the thickness of the polysilicon layer 409 is in the range of 10-20 microns.

Figure 4F:
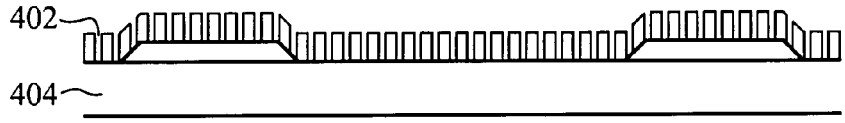
Figure 4G:
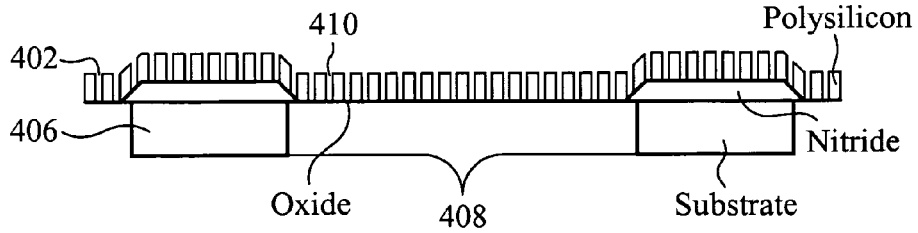
Figure 4H:
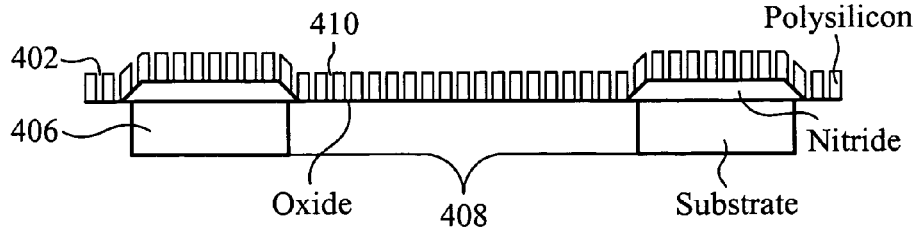

Next, the plurality of pore apertures 410 are formed in the polysilicon layer 409, as shown in FIG. 4F. The pore apertures 410 can be formed using the plasma etch teaching recited in the first method. Once the pore apertures 410 are formed in the polysilicon layer 409, the process proceeds by forming the support apertures 408 and support structures 406 by plasma etching the support structures 406 and apertures 408 out of the substrate 401. From FIG. 4G, a support structure 406 is formed at each alignment mark 405 in the bond layer. Alternatively, the support structures 406 and support apertures 408 are formed before the pore apertures 410 are formed. Once the pore apertures 410 and support structures 406 are formed, the entire pump 400 is preferably dipped in HF to remove all oxide between the polysilicon layer 409 and the top surface of the substrate 401, as in FIG. 4H. This HF etch FIG. 4H also opens the interface between the pore apertures 410 and the support apertures 408. As stated above, an advantage of this process is that the HF etch step is self-terminated, because the bonding material is not attacked by the HF during the etching process. Therefore, the support structures 406 are ensured to stay attached to the pumping element 402 regardless of how long the pump 400 is exposed to the HF.

Next, the structure is oxidized to form an oxide layer 318 on all the surfaces of the pumping element 402 and support structure 404 to passivate the surfaces and to reduce the diameters of the pore apertures 410.

FIGS. 5A-5D illustrates another alternative method of fabricating the pump in accordance with the present invention. In the alternate process, a standard silicon wafer substrate 501 is provided, as shown in step 30. In addition, as shown in step 32, a frit 502 is bonded to one side of the wafer 501, preferably on the top side of the wafer 501. In this embodiment, the frit 502 is preferably made of a glass or ceramic material that is insulates against the transfer of current. Such material preferably includes Silicon Nitride or Borosilicate glass. It is contemplated that other materials or types of ceramics and glass are alternatively used. The frit 502 is bonded to the wafer 501 using a high temperature fusing process, although other methods are alternatively used. In addition, a Chemical-Mechanical Polishing (CMP) process or any other method is performed on the frit 501 to grind and smooth the surface of the flit 501 down to a predetermined thickness, which is approximately 100 microns. Alternatively, the frit 502 may be polished or smoothed to any other appropriate thickness.

Figure 5C:
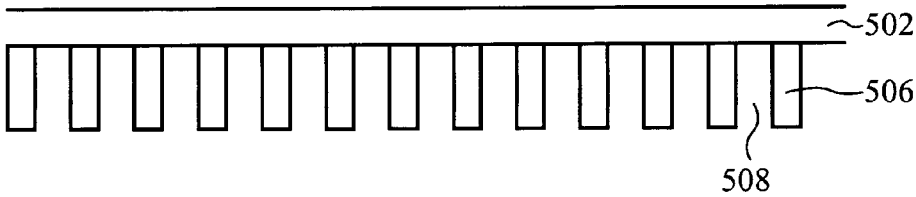
Figure 5D:
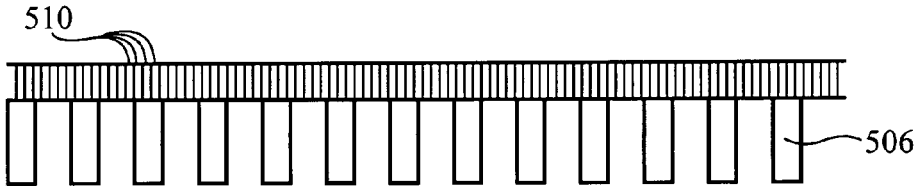
Figure 6:
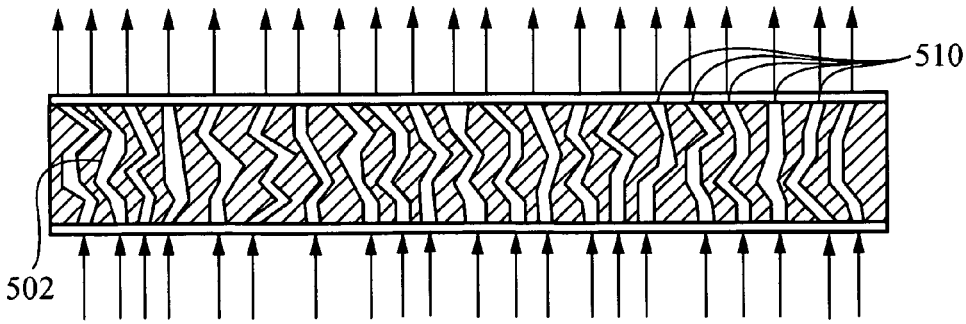
FIG. 6 illustrates an alternate embodiment of a fit having non-parallel pore apertures in accordance with the present invention.

As shown in FIG. 5C, the support structures 506 are formed into the wafer 501 by an etching process, such as plasma etching. Alternatively, any other process can be used to form the support structures 506. Specifically, the support structures 506 are formed by turning the substrate 501 and bonded frit 502 upside down, whereby the substrate 501 faces upward. Next, the etching process is performed to the substrate 501, whereby the support structures 506 and corresponding support apertures 508 are formed. It should be noted that the steps of polishing and forming the support structure may be done in any order, whereby the polishing is performed either before or after the support structures are formed. Following, the pore apertures 510 may be formed by a plasma etching process, whereby the pore apertures 510 are formed between the top and bottom surfaces of the frit 512 and have straight, parallel configurations. Alternatively, as shown in FIG. 6, non-parallel, complex shaped pore apertures may already be present in the frit 502 and the pore apertures 510 need not be formed by the etching process.

Once the pumping element 302 and support element 304 are formed by any of the above processes, metal is preferably deposited on the outside surfaces of the pumping element 302, thereby forming electrodes 316 on surfaces of the pumping element, as shown in FIG. 3F. The electrodes 316 are fabricated from materials that do not electrically decompose during the electrolysis process. Preferred materials for the electrodes 316 include Platinum and Graphite; although other materials may serve as well, depending on the composition of the fluid being pumped. The electrodes 316 are formed on the outside surfaces of the pumping element 302 in a variety of ways. Preferably, the electrodes 316 are formed on the outside surfaces of the pumping element 302 by evaporation, chemical vapor deposition (CVD), or plasma vapor deposition (PVD). Alternatively, the electrodes 316 are formed on the outside surfaces of the pumping element 302 by screen or contact printing. Alternatively, an electrode screen (not shown) may be positioned in a close proximity to the outside surfaces of the pumping element 302. Alternatively, a wire is coupled to each outside surface of the pumping element. It should be noted that the electrodes coupled to the pumping element of the present invention are not limited to the methods described above.

Figure 7:
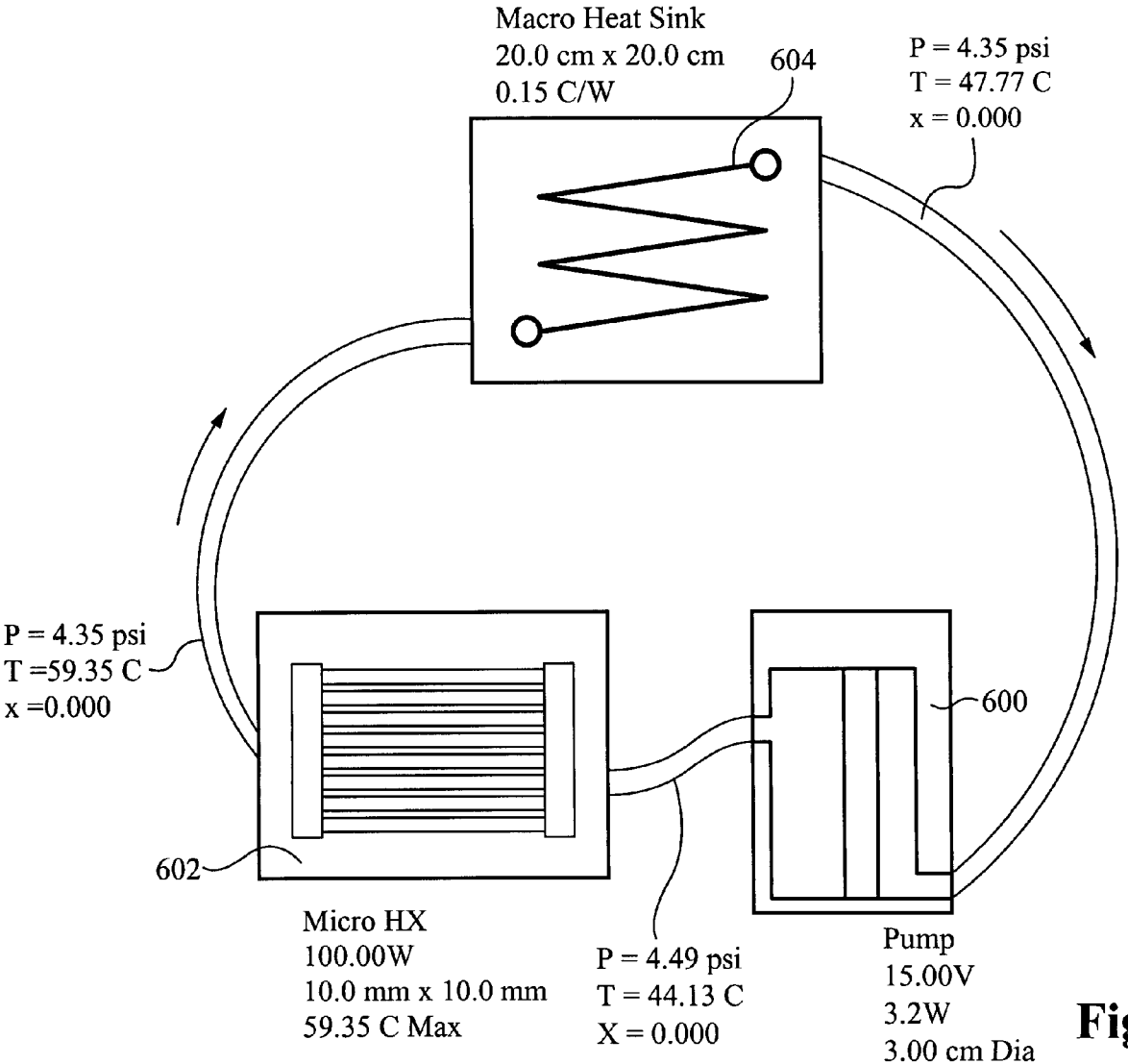
FIG. 7 illustrates a closed system loop including the pump of the present invention.

FIG. 7 illustrates a cooling system for cooling a fluid passing through a heat emitting device, such as a microprocessor. As shown in FIG. 7, the system is a closed loop whereby liquid travels to an element to be cooled, such as a microprocessor 602, whereby heat transfer occurs between the processor and the liquid. After the leaving the microprocessor 602, the liquid is at an elevated temperature of 59° C. and enters the heat sink 604, wherein the liquid is cooled within to a temperature of 44° C. The liquid leaves the heat sink 604 at the lower temperature of 44° C. and enters the pump 600 of the present invention. Again, referring to FIG. 2, within the pump 100, the cooled liquid enters the support apertures 108 and is pumped through the pore apertures 110 by the osmotic process described above. In particular, the voltage applied to the pumping element 102 causes the negatively electrically charged ions in the liquid to be attracted to the positive voltage applied to the top surface of the pumping element 102. Therefore, the voltage potential between the top and bottom surface of the pumping element drives the liquid through the pore apertures 110 to the top surface, whereby the liquid leaves the pump 100 at substantially the same temperature (44° C.) as the liquid entering the pump (44° C.).

The pump of the present invention produces enough flow that sufficient heat rejection with a single-phase fluid is possible. Existing pumps that operate with 100 Watt heat sources require 2-phase heat rejection, whereas single-phase fluids can capture and reject heat at lower temperatures and thereby eliminate possible problems associated with stability and phase change in a 2-phase system. In addition, the reduction in operating voltage to very low levels allows the use of existing voltages in all electronic systems without conversion between phases.

The pump of the present invention is able to operate with complicated fluids, such as antifreeze or water having additives to improve the heat capture and rejection properties. As stated above, current passes into the fluid through a chemical reaction, whereby the current passes through the electrodes 316 (FIGS. 3A-3F) in the electrokinetic pump 100. In pure $H_2O$, this reaction results in electrolysis, which produces pure $H_2$ gas at one electrode 316 and pure $O_2$ gas at the other electrode 316. In more complicated fluids, this reaction results in much more complicated byproducts, many of which cannot be efficiently recombined in a sealed system. The chemical reaction at the electrodes 316 takes place if there is enough energy available, in the form of potential difference between the electrodes, to overcome the affinity of the charges for the electrodes. For $H_2O$, these potentials, called overpotentials, add a voltage of approximately 4 Volts. For other chemicals and additive, these overpotentials vary and are accordingly different.

If an electrokinetic pump operates at high voltage, the overpotentials are so small that they are neglected in the analysis. However, for low-voltage operation, the overpotentials subtract from the voltage being applied to the pumping element 102, thereby causing the actual potential difference within the pumping medium to be reduced by an amount equal to the sum of the overpotentials for the reactions at the 2 electrodes. For a multi-component fluid, the electrochemical reactions will involve all the constituents of the fluid if the applied voltage is large enough to overcome the overpotentials of all the reactions. However, operation at low voltages may allow the electrochemistry to take place with only some of the constituents of the fluid.

For example, if $H_2O$ includes additives which inhibit freezing at low temperatures, the overpotentials of the additives are significantly higher than the overpotentials of pure $H_2O$. For the exchange of ions in the electro-osmosis process in regard to $H_2O$, there is a range of applied voltages which are low enough that only the $H_2O$ participates in the reactions at the electrodes. The advantage of this circumstance is that the electrochemistry can be kept simple (involving only $H_2$ and $O_2$) even in a fluid that has a complicated chemical makeup. An important advantage of the low-voltage operation enabled by the pump 100 of the present invention is that it becomes possible to generate adequate flow and pressure for high-power device cooling at voltages that are below the overpotentials of some useful additives, such as antifreeze. Some examples of additives which serve the purpose of depressing the freezing point of the liquid being pumped are Cyclohexanol and Acetonitrile. These additives are soluble in water at low concentrations and are well-characterized.

The electrode potentials for these additive chemicals are calculated from theory. However, the overpotentials are typically 2-3 times larger than the theoretical minimum electrode potentials. In addition, the overpotentials are generally a function of chemistry, geometry, roughness, and current density at electrode/electrolyte interface. The values of overpotentials are estimated for a given electrode material/electrolyte pair and depend on the behavior of the type of additive; specific concentration of the additive and the type of specific system within which the additive is used.

Like most thermophysical properties, the electrolytic currents of mixtures are not a linearly superposable or weighted effect of the components of the mixture. Instead, an additive at low concentration tends to have negligible effect on the current of the cell up to some critical concentration. The situation is analogous to a circuit with two diodes in parallel where the threshold potential of each is a function of its concentration in the mixture. The lower threshold diode tends to use all of the current. In the present invention, a low-concentration additive with a higher overpotential than water will only divert a small part of the current in the pump, even if the applied potentials are greater than the overpotentials of the additives. The operating voltage of the pump can still be relatively high, and the electrochemical reactions will still tend not to involve the additives if their overpotentials are higher than the water.

In addition, the effect of the additives on the cryoscopic constants appear not to correlate with the critical concentration. Therefore, cyclohexanol or acetonitrile or some other additive at low concentrations is added and has a beneficial effect on the freezing point without affecting the electrochemical reactions at the electrodes. Therefore, the best additives are soluble chemicals with high cryoscopic constants that are effective at low concentrations.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

What is claimed is:

1. A method of fabricating an electrokinetic pump comprising the steps of:

providing a first material having a first surface and a second surface;

coupling a second material to the second surface of the first material;

forming a plurality of support structures in the second material, with a support aperture formed in between each support structure;

forming a plurality of capillaries through the first material, wherein each capillary includes a pore aperture in the first surface and the second surface of the first material;

oxidizing the first surface and the second surface with an insulation agent, wherein an inner surface of each capillary is oxidized with a thin film of the insulation agent; and coupling a first electrode to the first surface and a second electrode to the second surface, wherein a plurality of the pore apertures in the second surface of the first material are disposed in between the support structures and are fluidly coupled to the same support aperture, enabling a liquid to flow from the same support aperture into the plurality of the pore apertures in the second surface of the first material disposed in between the support structures, and wherein a voltage potential generated between the first electrode and the second electrode drives the liquid to flow through the plurality of capillaries.

2. The method according to claim 1 wherein the step of coupling a second material to the second surface of the first material comprises the steps of:

applying an oxide agent to the second surface of the first material; and coupling the second material to the oxide agent.

3. The method according to claim 2, wherein each support structure is coupled to the first material by the oxide agent.

4. The method according to claim 3 further comprising removing a predetermined amount of the oxide agent from the second surface, wherein the removal of the predetermined amount results in exposure of the second surface of the first material that is disposed in between the support structures, while maintaining an amount of oxide agent between the support structures and the second surface to prevent the support structures from separating from the second surface.

5. The method according to claim 4 wherein hydrofluoric acid is applied to the predetermined amount of oxide agent to be removed.

6. The method according to claim 2 further comprising the step of oxidizing each support structure with the insulation agent.

7. The method according to claim 1 wherein the plurality of capillaries are formed by an etching process.

8. The method according to claim 1 wherein a diameter of the pore aperture is in a range of 0.1 and 2 microns.

9. The method according to claim 1 wherein the first material includes a thickness dimension in a range of 10 microns and 1 millimeter.

10. A method of fabricating an electrokinetic pump comprising the steps of:

providing a substrate having a first surface and a second surface;

forming a plurality of alignment marks on the first surface of the substrate, wherein the alignment marks are made of a first material;

applying a second material to the first surface of the substrate, the second material having a first surface and a second surface;

forming a plurality of capillaries through the second material, wherein each capillary includes a pore aperture in the first surface and the second surface of the second material;

forming a support structure at each alignment mark in the substrate, thereby forming a plurality of support structures, wherein a support aperture and an exposed portion of the second surface of the second material is formed between each support structure; and applying a diffusion oxidizing agent to the first surface and the exposed portion of the second surface of the second material, wherein the diffusion oxidizing agent is applied within the plurality of capillaries, wherein a plurality of the pore apertures in the exposed portion of the second surface of the second material are disposed in between the support structures and are fluidly coupled to the same support structure, enabling a liquid to flow from the same support structure into the plurality of the pore apertures in the exposed portion of the second surface, and wherein a voltage differential applied between the first and second surface of the second material drives liquid through the plurality of capillaries.

11. The method according to claim 10 further comprising the step of applying the diffusion oxidizing agent to an outer surface of each support structure.

12. The method according to claim 10 further comprising the step of applying an oxide agent to the first surface of the substrate before the second material is applied to the first surface of the substrate.

13. The method according to claim 12 further comprising the step of removing the oxide agent from the second surface of the second material.

14. The method according to claim 10 further comprising the step of coupling means for applying the voltage differential to the first surface and second surface of the second material.

15. The method according to claim 10 wherein the first material is a glass material.

16. The method according to claim 10 wherein the first material is a ceramic material.

17. The method according to claim 10 wherein the second material is a polysilicon material.

18. The method according to claim 10 wherein a diameter of each of the plurality of capillaries is in a range of 0.1 and 2 microns.

19. The method according to claim 10 wherein the second material includes a thickness dimension in a range of 10 microns and 1 millimeter.

* * * * *